US008776706B2

(12) United States Patent
Baylot et al.

(10) Patent No.: US 8,776,706 B2
(45) **Date of Patent: *Jul. 15, 2014**

(54) BUOYANCY DEVICE AND A METHOD FOR STABILIZING AND CONTROLLING THE LOWERING OR RAISING OF A STRUCTURE BETWEEN THE SURFACE AND THE BED OF THE SEA

(75) Inventors: Michel Baylot, Marseilles (FR); Marc Bonnissel, Neuilly S/Seine (FR); Xavier Rocher, Chatou (FR)

(73) Assignee: Salpem S.A., Montigny le Bretonneux (FR)

( * ) Notice: Subject to any disclaimer, the term of this patent is extended or adjusted under 35 U.S.C. 154(b) by 841 days.

This patent is subject to a terminal disclaimer.

(21) Appl. No.: 12/859,338

(22) Filed: Aug. 19, 2010

(65) Prior Publication Data

US 2011/0005452 A1 Jan. 13, 2011

Related U.S. Application Data

(63) Continuation of application No. 10/550,818, filed as application No. PCT/FR2004/000741 on Mar. 25, 2004, now Pat. No. 7,882,794.

(30) Foreign Application Priority Data

Mar. 26, 2003 (FR) ..... 03 03969

(51) Int. Cl.
*B62C 7/00* (2006.01)
*B63G 8/14* (2006.01)

(52) U.S. Cl.
USPC ..... 114/50; 114/331

(58) Field of Classification Search
USPC ..... 114/50–54, 230.2, 230.23, 294, 312, 114/313; 441/23–25, 28; 405/8–13, 60
See application file for complete search history.

(56) References Cited

U.S. PATENT DOCUMENTS

| | | | |
|---|---|---|---|
| 2,975,807 | A | 3/1961 | Waninger |
| 3,295,489 | A | 1/1967 | Bossa |
| 3,376,588 | A | 4/1968 | Berteaux et al. |
| 3,881,439 | A | 5/1975 | Svanholm |

(Continued)

FOREIGN PATENT DOCUMENTS

| | | |
|---|---|---|
| EP | 1 449 762 | 8/2004 |
| EP | 1 568 600 | 8/2005 |
| FR | 1488159 | 6/1965 |
| FR | 2 291 903 | 11/1974 |

(Continued)

*Primary Examiner* — Daniel V Venne
(74) *Attorney, Agent, or Firm* — Cozen O'Connor

(57) ABSTRACT

A method of using a buoyancy fluid presenting density that is less than that of sea water, and that is confined in a rigid or flexible leaktight casing, so as to constitute an immersed buoyancy element, wherein the buoyancy fluid is a compound that is naturally in a gaseous state at ambient atmospheric temperature and pressure, and in a liquid state at the underwater depth to which the buoyancy element is immersed. A method is also disclosed for placing a buoyancy element in place between the surface and the bed of the sea, wherein fluid is stored in a tank on a surface ship as a liquid in the cooled or compressed liquid state, and is injected in the liquid state into a pipe from the surface where it is stored to an immersed casing at an underwater depth at which the underwater pressure is not greater than the vapor pressure of the gas corresponding to the compound at the temperature at the depth.

15 Claims, 10 Drawing Sheets

(56) References Cited

U.S. PATENT DOCUMENTS

| | | | | |
|---|---|---|---|---|
| 4,183,316 | A * | 1/1980 | Bennett | 114/331 |
| 4,284,110 | A | 8/1981 | Divelbiss et al. | |
| 4,358,218 | A | 11/1982 | Graham | |
| 4,658,745 | A | 4/1987 | Buecher | |
| 5,516,235 | A | 5/1996 | Stangroom | |
| 6,772,705 | B2 * | 8/2004 | Leonard et al. | 114/333 |

FOREIGN PATENT DOCUMENTS

| | | |
|---|---|---|
| FR | 2 804 935 | 11/1974 |
| GB | 336950 | 10/1930 |
| GB | 2 063 776 A | 6/1981 |
| GB | 2 071 020 A | 9/1981 |
| WO | WO 82/01387 | 4/1982 |
| WO | WO 03/095788 | 11/2003 |

* cited by examiner

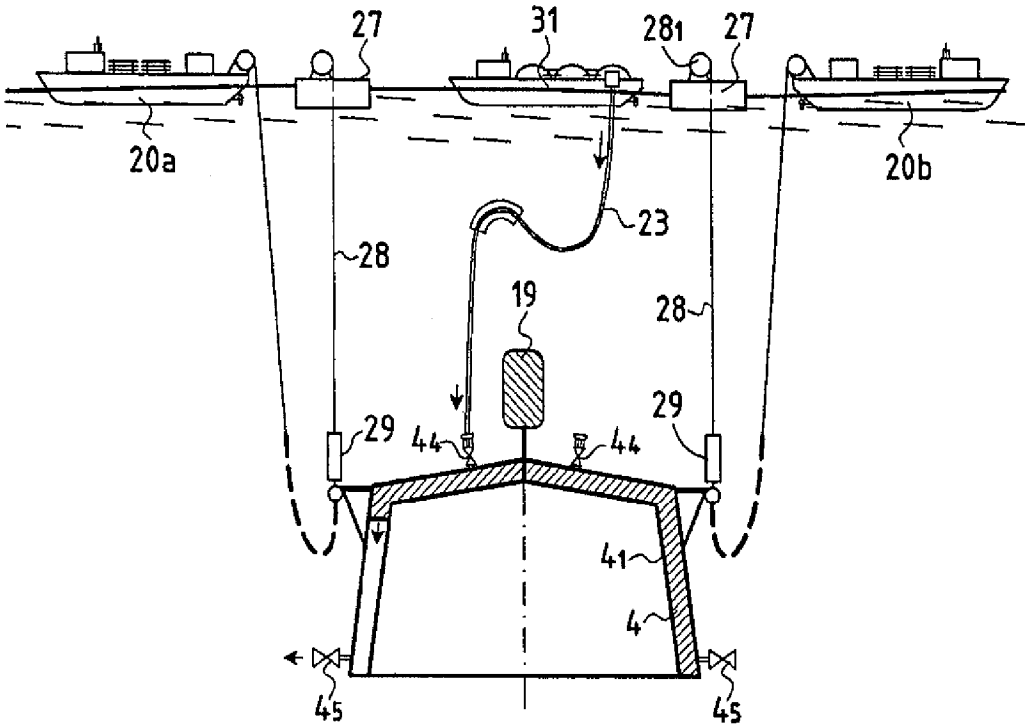
FIG.7B
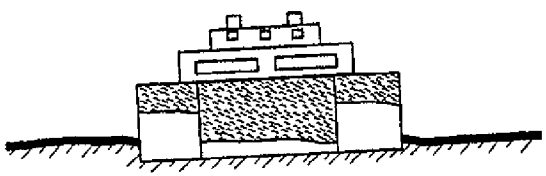
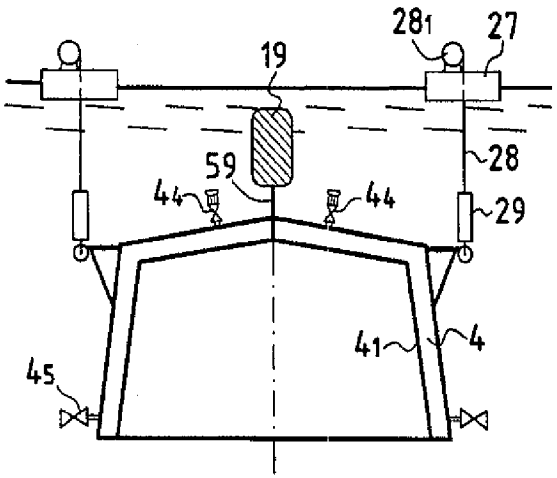
FIG.7A
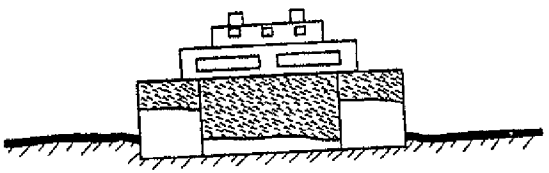

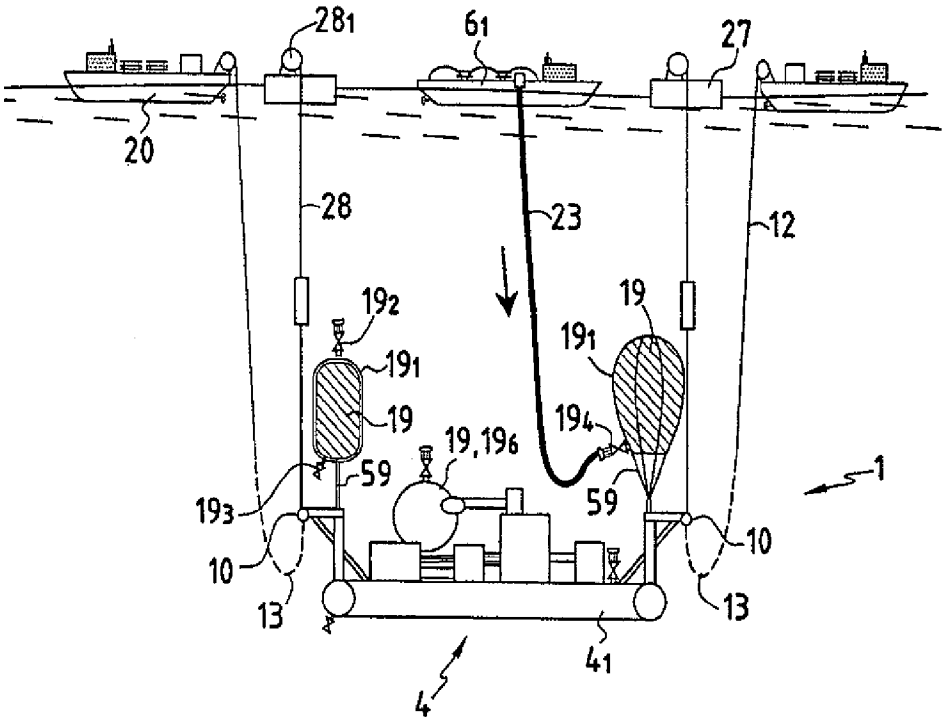
FIG.10B
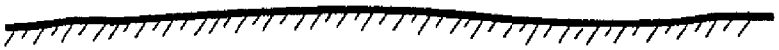
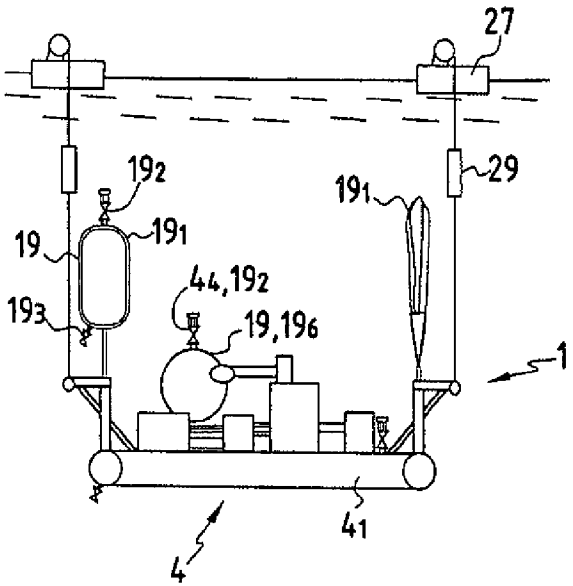
FIG.10A
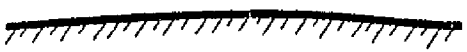

BUOYANCY DEVICE AND A METHOD FOR STABILIZING AND CONTROLLING THE LOWERING OR RAISING OF A STRUCTURE BETWEEN THE SURFACE AND THE BED OF THE SEA

PRIORITY CLAIM

This is a continuation application of U.S. application Ser. No. 10/550,818, Sep. 23, 2005, now U.S. Pat. No. 7,882,794 which is a U.S. national stage of application No. PCT/F2004/000741, filed on 25 Mar. 2004, which claims priority from the following application: Country: France, Application No.: 03/03969, the content of which is incorporated here by reference.

FIELD OF THE INVENTION

The present invention relates to the use of a buoyancy fluid presenting density that is less than that of sea water, and that is confined in a rigid or flexible leaktight casing, so as to constitute an immersed buoyancy element.

The present invention also relates to a buoyancy device or buoyancy element for making a heavy structure lighter, and to a method of putting a said buoyancy element into place in an immersed position between the surface and the bed of the sea.

The present invention also relates to a method of stabilizing and controlling the lowering and raising of a said structure between the surface and the bed of the sea, said structure comprising or being connected to at least one buoyancy element constituted by a casing in which said buoyancy fluid of the invention is confined in leaktight manner.

The term "structure" refers to any equipment, tool, machine, and in particular risers, underwater well-head elements on oilfields, or oil processing units, that are to be installed in the sea or on the sea bed, or even to a receptacle having a leaktight compartment that is useful for recovering polluting effluent from a wreck.

BACKGROUND OF THE INVENTION

The lowering and raising of the massive structures that are to be lowered to the sea bed or raised from the sea bed to the surface, is difficult because of the mass of said structures or of said shuttle tanks. It is known to lower loads having an apparent weight in water of several hundred (metric) tonnes to the sea bed using hoist means situated on a floating support, e.g. a crane; but when the depth becomes considerable, the use of conventional steel cables is problematic since, in addition to the load of said structure, it must also support its own weight, and that can represent up to 50% of said load capacity for a depth of 3000 meters (m). Synthetic cables can also be used that do not present that drawback, but their cost is very high and their use with winches or capstans presents extreme difficulties for heavy loads and depths of 1000 m to 4000 m, or even greater.

In order to lower such loads, it is advantageous to make them lighter by adding buoyancy elements thereto that reduce their apparent weight in water, consequently requiring hoists of lower capacity.

The term "buoyancy element" refers to an element that presents a dead weight that is lighter than sea water, and that thus makes it possible to increase the overall buoyancy that it forms together with the structure to which it is connected or in which it is integrated.

The term "to increase the buoyancy" of an element when it is immersed refers to increasing the ratio ω between the buoyancy thrust exerted on said element and its dead weight out of water. Thus, if said ratio is $\omega<1$, the element has negative buoyancy, so it tends to sink, if $\omega=1$, said element is in equilibrium, and if $\omega>1$ said element floats and its buoyancy increases as ω increases.

The buoyancy of the structure can be made positive so as to make it easier for said structure to rise. For "positive buoyancy", said buoyancy elements compensate the weight of said structure, so that the buoyancy thrust that is applied both to said structure and to said buoyancy elements is not less than the dead weight of said structure and said buoyancy elements taken together, with the resultant of the forces being directed upwards for positive buoyancy.

The additional buoyancy is generally achieved by using airtight tanks that are filled with air and secured to said load. Such buoyancy elements constituted by air-filled tanks must be capable of withstanding the maximum immersion pressure without imploding or deforming, since the buoyancy would be reduced correspondingly, or even eliminated. The tank must thus be strong enough to withstand the pressure that corresponds to the envisaged immersion depth, which pressure is about an additional 10 mega pascals (MPa) for each additional 1000 m of water depth. Thus, for very great depths, e.g. greater than 1000 m, the casing of the tank must be reinforced sufficiently to withstand the pressure, and its dead weight is consequently much heavier, thereby reducing the performance of said buoyancy element considerably. In order to limit the effects of water pressure at great depth, the tank is advantageously pressurized before it is lowered, thereby making it possible to reduce the dead weight of the tank, since, at the maximum immersion depth, the pressure difference between the outside and the inside is smaller and the wall needs less strength; however, the tank must be capable of withstanding the initial burst-pressure during pressurization.

In order to create said buoyancy, it is also possible to use liquids that are quasi-incompressible, and that present density that is less than that of sea water, e.g. liquids such as fresh water, gas oil, or methanol, that enable less strong casings to be used. However, those materials do not present a ratio ω (buoyancy thrust/dead weight) that is as great as does air, namely: $\omega=1.026$ for fresh water; $\omega=1.21$ for gas oil; and $\omega=1.30$ for methanol.

In order to create buoyancy at very great depths, it is also conventional to use rigid syntactic foam that is made up of microspheres, generally made of glass and of small diameter, mixed with a binder of the polyurethane or epoxy type. That type of foam is capable of withstanding considerable pressure and presents a ratio ω (buoyancy thrust/dead weight) that is more advantageous, lying in the range $\omega=1.70$ to 2.05 for foams that present density lying in the range 0.6 to 0.5, and that are capable of withstanding depths of 1500 m to 2000 m. For syntactic foams that are capable of withstanding greater depths, their density is greater and the ratio ω thus decreases rapidly. Furthermore, such materials based on syntactic foam are very costly and very difficult to manufacture in large volumes, especially for extreme depths.

Once the load is placed on the sea bed, the buoyancy should generally be eliminated so that said load remains stable. For an air-filled tank, it suffices merely to open the valves so that said tank fills with sea water. For a float having a solid buoyancy material such as syntactic foam, the only solution is to separate it by cutting the connections that connect it to the load, and to raise it to the surface, either in controlled manner, which takes a considerable amount of time, or by allowing it to rise freely without any control, which risks creating accidents with the various ships operating at the surface.

The addition of such buoyancy elements makes it possible to reduce the apparent weight in water of the load, but the mass of said load is thus increased by said buoyancy, and by the "added mass" of water, i.e. the mass of water adjacent to the load that is entrained upwards or downwards during vertical movements. Thus, during lowering, although the apparent weight in water of the load may be very light, the inertial mass to be considered is constituted by the mass of the load itself, plus the mass of the buoyancy elements, plus the "added mass" of water, and this can represent an overall inertial mass of 400 tonnes or 500 tonnes for a load mass of 100 tonnes.

It is generally sought to improve the performance of the buoyancy elements, so as to minimize not only the overall inertial mass, but also the size of said buoyancy elements, so as to limit the effects of underwater currents on the load as a whole.

OBJECTS AND SUMMARY OF THE INVENTION

An object of the present invention is to provide a buoyancy material and to make buoyancy elements that make it easier to install heavy loads, possibly weighing several hundreds of tonnes, or even several thousands of tonnes, in water depths of 1000 m to 4000 m, or even greater, that are inexpensive, easy to make and use, and that present a ratio $\omega$=(buoyancy thrust/dead mass) optimum, i.e. considerably greater than 1, and in particular greater than 1.5, and furthermore having a value $\omega$ that is almost independent of the depth to which it is immersed, so as to make it easier to install said load, in particular by limiting the action sea currents both on the load and on the buoyancy element.

Another object of the present invention is to provide a buoyancy material that can be confined in a casing that does not need to be strong enough to withstand high pressure in order to be put into place at great depth.

Another object of the present invention is to provide a device and a method of controlling and facilitating the lowering and raising of a structure that is heavy, and possibly bulky, such as the above-mentioned receptacles for recovering effluent. However, the invention is also applicable to any other type of structure, and it is even applicable to stabilizing such a structure between the surface and the bed of the sea, particularly at great depth.

Another object of the present invention is to provide a method and an installation making it possible to confine and recover the content of the hold and/or tanks of a ship, e.g. an oil tanker, resting on the sea bed in great depths, e.g. greater than 3000 m or even 4000 m to 5000 m, while avoiding the drawbacks of prior art methods and devices, and in particular being easy and simple to implement in spite of being of very large dimensions.

Another object of the present invention is to provide a method and an installation making it possible to confine and recover polluting effluent from a vessel that has sunk, particularly in great depth, by means of an open-based rigid receptacle in the form of a cap that completely covers the shipwreck so as to channel all of the effluent escaping therefrom into a single volume, and so as to organize raising the polluting effluent to the surface from said receptacle at the sea bed under the best possible conditions.

Another more particular object of the present invention is thus to provide an open-based receptacle of cap-shape suitable for completely covering a wreck on the sea bed and for recovering polluting effluent escaping therefrom, and which is technically reliable and capable of being implemented on the sea bed using a method that is simple and technically reliable.

To do this, the present invention provides the use of a buoyancy fluid presenting density that is less than that of sea water, and that is confined in a rigid or flexible leaktight casing, so as to constitute an immersed buoyancy element, wherein said buoyancy fluid is a compound that is naturally in the gaseous state at ambient atmospheric temperature and pressure, and in the liquid state at the underwater depth to which said buoyancy element is immersed.

This type of compound is also commonly (and improperly) referred to as "liquefied gas".

Ambient atmospheric temperature and pressure conditions correspond to temperatures of −10° C. to +40° C., and to a theoretical absolute atmospheric pressure at sea level of 101,325 pascals (Pa), and having an approximate value of 100,000 Pa, i.e. 0.1 MPa, that is used throughout the description of the present invention.

Ambient temperature and pressure conditions underwater generally correspond to a temperature of 1° C. to 35° C., preferably 3° C. to 25° C., and to a pressure that is greater than atmospheric pressure, more precisely a pressure that increases by substantially $10^5$ Pa per 10 m increase in depth.

In some arctic regions, it is possible to find water at a temperature that is considerably lower than 0° C., e.g. −5° C. to −8° C., but as a general rule, deep water is about 1° C. to 4° C.-5° C. in all of the seas throughout the world.

The compounds of the invention present a critical temperature that is preferably greater than 35° C., and more preferably greater than 40° C. The term "critical temperature" refers to the temperature above which said compound is in a fluid state presenting properties belonging both to gases and to liquids, and therefore to a temperature above which said compound cannot be in the liquid state.

The present invention also provides an immersed buoyancy element imparting buoyancy to an immersed structure to which it is connected or secured, or in which it is integrated, said buoyancy element comprising a said immersed casing in which said liquefied compound is confined in leaktight manner.

In a first variant, said casing is constituted by, or is placed inside, the walls of a compartment of an immersed structure.

In a second variant, said casing is placed outside said structure to which it is connected or secured, and more particularly, said immersed structure is suspended from said buoyancy element by at least one cable.

In the second variant, said buoyancy element may comprise a said flexible casing preferably having a hydrodynamic profile, minimizing forces during its vertical movements when it is full of said buoyancy fluid.

In a preferred embodiment, said buoyancy fluid is naturally in the stable liquid state when it is placed at an underwater depth of 10 m to 500 m, and preferably of 20 m to 100 m. At such depths, the temperature lies in the range 3° C. to 25° C., and the pressure lies respectively in the range 0.1 MPa to 5 MPa, and preferably in the range 0.2 MPa to 1 MPa.

More preferably, said fluid is a fluid that is quasi-incompressible, and that presents a relative density in the liquid state of 0.3 to 0.8, and preferably of 0.5 to 0.7.

Also preferably, said gas is selected from ammonia, a C-2 to C-7 alkane, a C-2 to C-7 alkene, a C-2 to C-7 alkyne, and a C-4 to C-7 diene.

More particularly, compounds are selected that are easily available on the market, such as: ammonia, ethane, butane, propane, ethylene, propylene, butene, acetylene, methyl acetylene, propadiene, and butadiene.

The term "butene" refers to the various isomers such as butene-1 and cis- or trans-butene-2.

In a preferred embodiment, said compound is selected from ammonia, propane, and butane.

As explained below, said above-mentioned compounds represent a good compromise between their characteristic values of density in the liquid state and of vapor pressure. For gases in general, when density in the liquid state increases, vapor pressure at the reference temperature of 15° C. decreases, and therefore the minimum depth of water at which the compound is intended to be placed also decreases. The three compounds present densities lying substantially in the range 510 kilograms per cubic meter ($kg/m^3$) to 630 $kg/m^3$, and the minimum depths at which said rigid or flexible casings can be filled lie respectively substantially in the range 65 m to 7.5 m (see Table 1 below) when ambient temperature is about 15° C.

Thus, if the heavy structure presents a large number of leaktight internal cavities capable of serving as rigid casings, butane could advantageously be used. However, if it is necessary to make additional rigid or flexible outer casings, propane could advantageously be used, so as to minimize the size of said casings, and therefore minimize their cost. Since the saving in volume when using propane is about 15% compared with butane, this thus results not only in a reduction in the cost of the casing, but also in the cost of the liquefied gas, since the unit prices of butane and of propane are substantially the same. However, the transfer operations need to take place at greater depth, and in the event of using divers to supervise the operations, the necessary equipment and the personnel need to be of a higher standard, thereby incurring significant additional cost compared with mere surface diving.

The present invention also provides a method of putting a buoyancy element into place between the surface and the bed of the sea. In the invention, said fluid is stored in a tank on a surface ship as a liquid in the cooled or compressed state, and it is injected in the liquid state into a pipe from the surface where it is stored to a said immersed casing at an underwater depth at which the underwater pressure is not less than the vapor pressure of the gas corresponding to said compound at the ambient temperature at said depth.

When said casing is a flexible casing, it can be lowered to the desired depth empty, in a collapsed or folded state.

Advantageously, said casing is prefilled, at atmospheric pressure and temperature, with sea water or with another fluid, preferably an incompressible liquid compound such as gas oil, fresh water, or methanol, and the sea water or said other liquid is discharged from the casing as it fills with said buoyancy fluid.

In an advantageous embodiment, said casing is prefilled with sea water, and before it is filled with said buoyancy fluid of the invention, a limited quantity of methanol is injected, since methanol is suitable for preventing the formation of hydrates. Methanol which is of density that is intermediate between the densities of sea water and of a buoyancy fluid of the invention creates a screen preventing direct contact between said buoyancy fluid and the water, and thus prevents the hydrate-forming chemical reactions that occur when said buoyancy fluid is combined with water. Hydrates run the risk of blocking the pipework or of preventing the liquefied gases from being recovered at the end of the installation stage.

Still more particularly, said casing is filled at the surface with a said other fluid, and said casing filled in this way is lowered to a depth at which the hydrostatic pressure corresponds to the pressure at which said buoyancy fluid is subsequently injected into said casing with said other fluid being discharged.

In a variant embodiment, said buoyancy fluid is stored as a liquid in the cooled state in a cryogenic tank and at atmospheric pressure, and it is injected in the pressurized liquid state into said immersed casing at a pressure corresponding to the hydrostatic pressure at the depth of said casing, said buoyancy fluid passing through a heat exchanger so that the temperature of said fluid is brought substantially to that of the sea water at the depth of said immersed casing prior to filling said casing.

The present invention also provides a device for stabilizing or controlling the lowering or raising of a structure between the surface and the bed of the sea, said structure including or being connected to a buoyancy element of the invention, said device including at least one connection element of the cable or chain type, having:

- a first end that is connected to a winch on board a floating support or surface ship, and on which winch it is wound; and
- a second end that is connected to a fastener element on said structure, or on at least a first buoyancy element of the invention that is connected to said structure; and
- the length of said connection element is such that said winch is suitable for winding or unwinding said first end of said connection element, so that a bottom portion of said connection element can hang beneath said fastener element, i.e. beneath the fastener point for fastening said second end to said fastener element.

Where appropriate, said structure is therefore suspended from one or a plurality of said first buoyancy elements of the invention that are disposed thereabove. Said structure can also include second buoyancy elements integrated or incorporated inside said structure, i.e. said second buoyancy elements do not displace a volume of water that is additional to the volume of water displaced by said structure, preferably said second buoyancy elements of the invention.

It should be understood that the stabilizing device makes it possible to vary the length and therefore the weight of said bottom portion of the connection element hanging beneath said fastener element on said structure and supported by said structure.

For a massive structure, the stabilizing and control device of the invention includes at least two of said connection elements and said structure includes a plurality of said fastener elements, and said connection elements and said fastener elements are preferably disposed symmetrically, respectively around and on the periphery of said structure.

More precisely, the present invention also provides a method of lowering, raising, or stabilizing a structure between the surface and the bed of the sea by means of a stabilizing device, said method comprising the following steps: unwinding or winding each connection element at its first end by means of a said winch; and controlling the speed at which each connection element is lowered and raised by regulating the speed at which each connection element is respectively wound off or on said winch, so as to adjust the length of said bottom portion of said connection element hanging beneath said fastener element on said structure or said first buoyancy element, the lowering, raising, or stabilizing of said structure being obtained when the sum of the weight of the fraction of said bottom portion(s) of the connection element(s) between firstly said fastener point(s) for fastening to said fastener element(s) or said first buoyancy element on said structure, and secondly the lowest point of said bottom portion(s), plus the weight of said structure as a whole and of said first buoyancy element(s) of the invention, is respectively greater than, less than, or equal to the buoyancy thrust that is exerted on said structure and on said first buoyancy elements of the invention (i.e. the weight of the total volume of water displaced).

In an embodiment, the stabilizing and control device includes a said connection element constituted by a cable having a bottom portion that comprises weighting blocks disposed in a string on a said cable, said weighting blocks preferably being metal blocks secured to said cable by clamping.

In a preferred embodiment, said blocks present a shape such that when said bottom portion hanging beneath said fastener elements curves, two of said blocks disposed side by side are capable of coming into abutment against each other, thereby limiting the curvature of said cable.

More particularly, the curvature of said cable is limited so that the minimum radius of curvature of said cables at said bottom portion enables a minimum distance to be maintained between said cable and said structure that is sufficient to prevent any mechanical contact between them while said structure is being lowered or raised.

Still more particularly and advantageously, each of said blocks presents a cylindrical central portion between two frustoconical ends having axes (i.e. the axes of said cylinder and of the two frustoconical ends covering its end faces) that correspond to the direction of said cable when said cable is disposed linearly, two adjacent blocks being in contact at said frustoconical ends along a generator line of said frustoconical ends in the curved parts of said bottom portion.

In another embodiment, said connection element comprises a chain having a bottom portion that comprises links that are heavier than the links of the rest of the chain, and that are preferably larger so as to limit any curvature of the chain.

Where appropriate, said first buoyancy elements are advantageously disposed above said structure, with said structure being suspended therefrom, and where appropriate, said second buoyancy elements, preferably of the invention, are integrated in the top of said structure, preferably integrated above said fastener elements so that the center of gravity of said structure together with said first buoyancy elements of the invention is situated below the center of thrust that is exerted both on said structure and on said first buoyancy elements of the invention, so as to provide overall stability during the entire installation stage.

The term "center of thrust" refers to the point at which the resultant of the buoyancy thrust is exerted. (The center of thrust is the center of gravity of the volume of water displaced by said structure).

As mentioned above, said heavy structure can be constituted by any load, in particular a heavy load, module, tool, or base as described in European patent application publication No. EP 1 568 600 in the name of the Applicant, that is to be immobilized in the vicinity of the sea bed or anchored on a wall or an element lying on the sea bed.

Preferably, said structure is a rigid structure of steel, other metal, or composite synthetic material containing at least one and preferably a plurality of leaktight buoyancy compartments that are suitable for forming a said buoyancy element, with each of said compartments being fitted with at least one filling orifice and preferably with at least one emptying orifice, said leaktight compartments preferably being distributed symmetrically in said walls.

The leaktight compartments are cavities designed to be filled completely or in part with buoyancy fluid of the invention that is lighter than sea water, and they thus constitute compartments that provide buoyancy to the structure, thereby enabling it to be towed at the surface and then to be lowered to the sea bed while it is being put into place, under conditions that are technically reliable and simple to implement, as explained below.

Concerning the distribution of the compartments, the term "symmetrically" means that the compartments are disposed symmetrically about one or more midplanes of symmetry of said structure, thus making it possible as explained below to facilitate balancing and positioning the base of said structure in a manner that is substantially horizontal.

The rigid structure advantageously includes hollow tubular bars defining leaktight compartments, and forming said buoyancy elements of the invention.

Advantageously, provisional use is made of tanks or reservoirs associated with processing oil, in particular for separating water, oil, and gas, in order to define leaktight compartments forming said buoyancy elements of the invention.

In a particularly advantageous embodiment, said structure is a massive structure constituted by an open-based receptacle in the form of a cap, the receptacle comprising a peripheral side wall surmounted by a roof wall and being suitable for completely covering a wreck of a ship on the sea bed in order to recover polluting effluent escaping therefrom, said receptacle having at least one emptying orifice for discharging said effluent contained in the inside volume of said receptacle; said emptying orifice preferably being situated in the roof of the receptacle.

In general, said receptacle presents a longitudinal axis of symmetry like that of the ships it is designed to cover, and said receptacle presents a vertical longitudinal axial plane of symmetry when the open base of the receptacle is in the horizontal position, and more particularly, said receptacle also presents a second vertical plane of symmetry that extends transversely.

In order to make it easier to put said structure into place on the sea bed, said structure is fitted on the outside:

with a fastener element enabling said buoyancy elements and said cables or said chains to be secured thereto for lowering said structure from the surface, and for putting it into place, and, where appropriate, anchoring it to the sea bed; and preferably with thrusters, more preferably steerable thrusters enabling the receptacle to be moved in a horizontal direction in order to be positioned over said wreck.

Said fastener elements can thus enable additional floats of the invention to be fastened to said structure.

In order to make it easier to put said structure into place on the sea bed, said structure is fitted on the outside:

with one or more fastener elements enabling one or more of said buoyancy elements and one or more of said cables or one or more of said chains to be secured thereto for lowering said structure from the surface, and for putting it into place, and, where appropriate, anchoring it to the sea bed; and preferably with thrusters, more preferably steerable thrusters enabling the receptacle to be moved in a horizontal direction in order to be positioned over said wreck.

Said fastener elements can thus enable additional floats of the invention to be fastened to said structure.

The present invention also provides a method of putting a structure, and in particular a receptacle of the invention, into place in order to cover a shipwreck on the sea bed and recover polluting effluent escaping therefrom, said method comprising the following steps:

1) filling said leaktight compartments completely or partially with a said buoyancy fluid of the invention, so as to constitute a buoyancy element of the invention, with the extent to which said leaktight compartments are filled being adjusted so as to cause said structure, and in particular said receptacle, to occupy an equilibrium position when immersed close to the surface;

2) lowering said structure, and in particular said receptacle, to its desired immersed position close to the sea bed over the wreck by controlling lowering by means of a device for stabilizing or controlling the lowering or raising of a structure of the invention, in particular by means of a plurality of cables preferably unwound from winches on board surface ships, said cables being connected to lengths of heavy chain, the chains themselves being connected at their opposite ends to said fastener elements secured to said structure, and preferably being distributed symmetrically around the periphery of said structure, the weights of the lengths of chain hanging beneath the fastening points on said fastening elements enabling said structure to be lowered, and the lengths of said chains hanging beneath said fastening points of the fastening elements being adapted by winding said cables out or in, preferably around said winches so as to regulate the rate of descent of the receptacle and so as to ensure that the base of said structure, and in particular the open base of the receptacle, is maintained in substantially horizontal equilibrium throughout the descent;

3) once said structure is in place in its desired position, in particular when said receptacle is in position on the sea bed so as to cover said wreck, emptying said leaktight compartments filled with fluid lighter than sea water, and simultaneously filling said leaktight compartments with sea water.

Before and/or after step 1), but before above step 2), it is possible to use ships to tow said structure, and in particular said receptacle, while it is floating at the surface, said leaktight compartments being filled with air and the receptacle floating with neutral buoyancy level with the surface or with said leaktight compartments being completely filled with a fluid that is lighter than sea water.

At above step 1), it will be understood that the filling of said leaktight compartments with a fluid that is lighter than sea water is performed in the various compartments as a function of how they are distributed in the walls of the receptacle, so that the open base of said structure remains substantially horizontal and so that the center of buoyancy of the receptacle remains substantially above the center of gravity of said structure. This applies to selecting which compartments to fill and also the rates at which they are filled.

Advantageously, in step 1), additional buoyancy is applied to said structure using additional floats by means of said first buoyancy elements connected to said structure, and in particular to said receptacle, and in step 3), once said structure is in the desired underwater position, in particular on the sea bed, said additional floats are released.

Also advantageously, after step 1) and before step 2), once said structure has reached the desired position, in particular in the vicinity of the sea bed, the lengths of said heavy chains hanging beneath said fastening elements and supported by said structure are reduced so as to stabilize said structure in suspension, and where appropriate, said structure is anchored to the sea bed, and then said heavy chains are fully lowered so that their entire weight contributes to stabilizing said structure, and in particular said structure, on the sea bed.

The heavy chains may be recovered by being disconnected from said structure, but as explained below, in order to increase the stability of said structure, and in particular of said receptacle, said heavy chains may have both ends connected to said fastening elements on said structure, or more simply the free ends of said heavy chains may be laid over the roof of said structure, and in particular of said receptacle, while still connected to the cables themselves connected to the surface ships, and then the cables connected to the surface ships are separated from said chains.

Advantageously, in the method of the invention, said structure may be positioned by actuating thrusters mounted outside said structure and preferably distributed symmetrically about its periphery.

Still more particularly, in a method of the invention, in step 1), said leaktight compartment(s) or casing(s) connected to said structure are filled with sea water or with a first fluid that is lighter than sea water and corresponding to a said buoyancy fluid of the invention; and in step 2), said structure is lowered to a depth of 30 m to 60 m corresponding to a pressure of 3 bars to 6 bars, at which depth a liquefied gas that is lighter than sea water is injected under pressure into said leaktight compartment(s) from a gas tanker ship on the surface, so as to form a buoyancy element of the invention.

Using liquefied gas as the fluid lighter than sea water makes it possible to obtain fluids having relative density in the liquid state lying in the range 0.5 to 0.7, thus giving two to three times more buoyancy than gas oil (d=0.85), and thus making it possible to use leaktight compartments of considerably smaller volume. In addition, in the event of an accident occurring such substances are much less polluting than gas oil or other oil, since they disperse naturally on reaching the surface by returning to the gaseous state.

Finally, the present invention also provides a method of recovering polluting effluent that is lighter than sea water, as contained in the tanks of a shipwreck lying on the sea bed, in which method:

1) a receptacle is put into place in accordance with a method of the invention for stabilizing and controlling descent; and 2) the effluent recovered inside said receptacle is collected by being emptied out through said top emptying orifice.

In order to recover effluent escaping through said top emptying orifice, it is possible to use a pipe connected to a surface ship or recovery devices of the kind described in French patent No. FR 2 804 935 of the Applicant, or indeed to use shuttle tanks as described in as yet European patent application publication No. EP 1 449 762 in the name of the Applicant.

BRIEF DESCRIPTION OF THE DRAWINGS

Other characteristics and advantages of the present invention appear better on reading the following description given in illustrative and non-limiting manner with reference to the accompanying drawings, in which:

FIGS. 7*a* and 7*b* are side views in section of a sarcophagus respectively while it is being towed, its buoyancy compartments being filled with sea water (FIG. 9*a*), and vertically above the wreck during the stage in which said buoyancy compartments are filled with a low-density liquefied gas (FIG. 9*b*);

FIG. 10*a* is a side view in section of a structure consisting of an oil processing module that is suspended below the surface by means of cables from two floating barges, the assembly being towed to the installation site;

FIG. 10*b* is a side view in section of said oil processing module lowered to a depth of 20 m to 40 m, a gas tanker ship transferring the buoyancy fluid to a flexible casing of the bag type;

DETAILED DESCRIPTION OF THE PRESENTLY PREFERRED EMBODIMENTS

Figure 1:
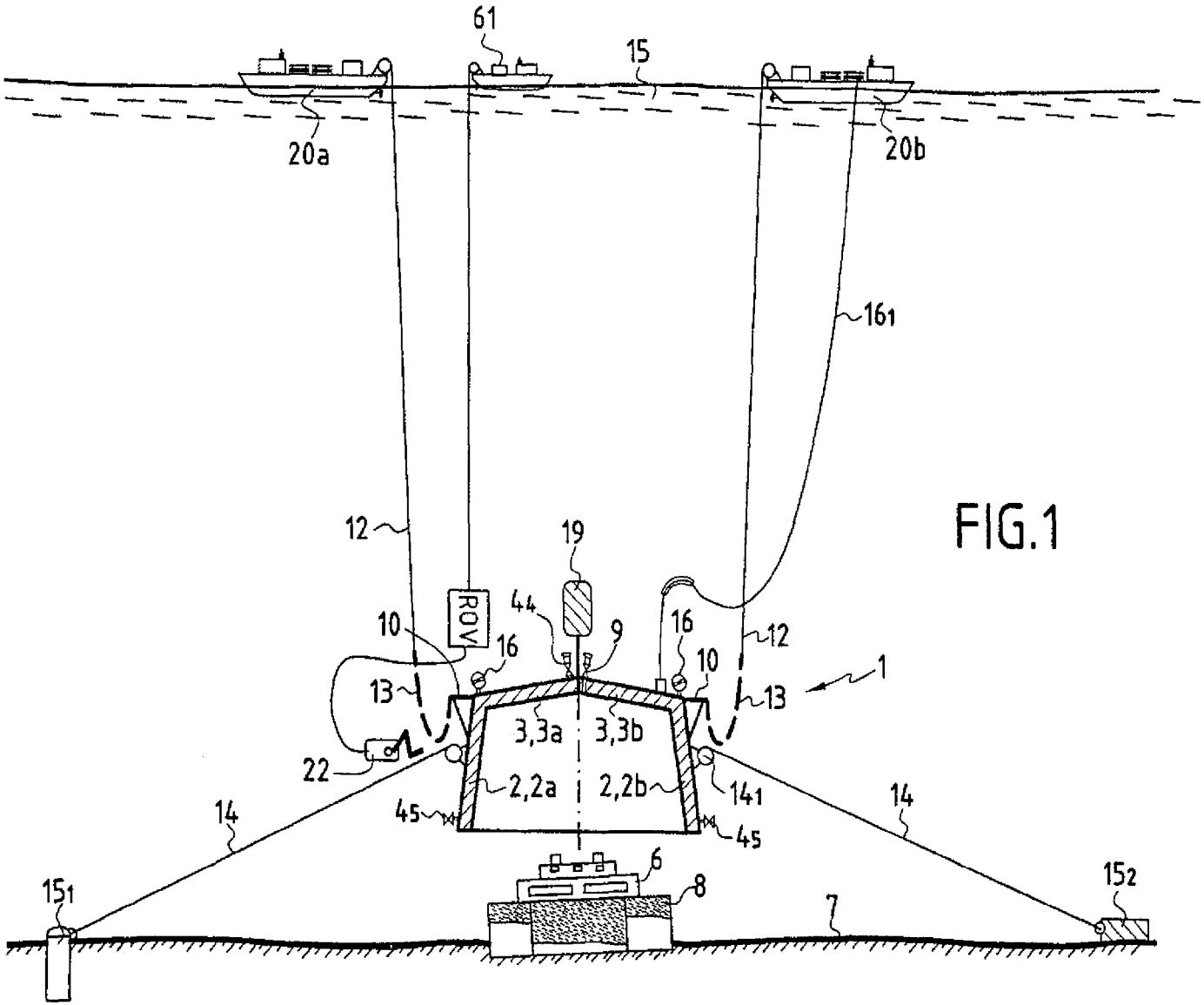
FIG. 1 is a side view in section of a said structure consisting of a receptacle referred to herein as a "sarcophagus" while it is being lowered towards a wreck.

FIG. 1 shows the hull of a wreck or a wall of a tank 6 lying on the sea bed 7 and filled with hydrocarbon 8 of density lower than that of sea water. Said hydrocarbon is confined in the top portion of the tank or the wreck 6, its bottom portion being filled with sea water. The ship 6 generally possesses multiple openings that are hermetically closed at deck level, and leakage might occur whenever the sealing becomes damaged because of the hull becoming deformed or breaking while the ship was being wrecked.

Figure 2:
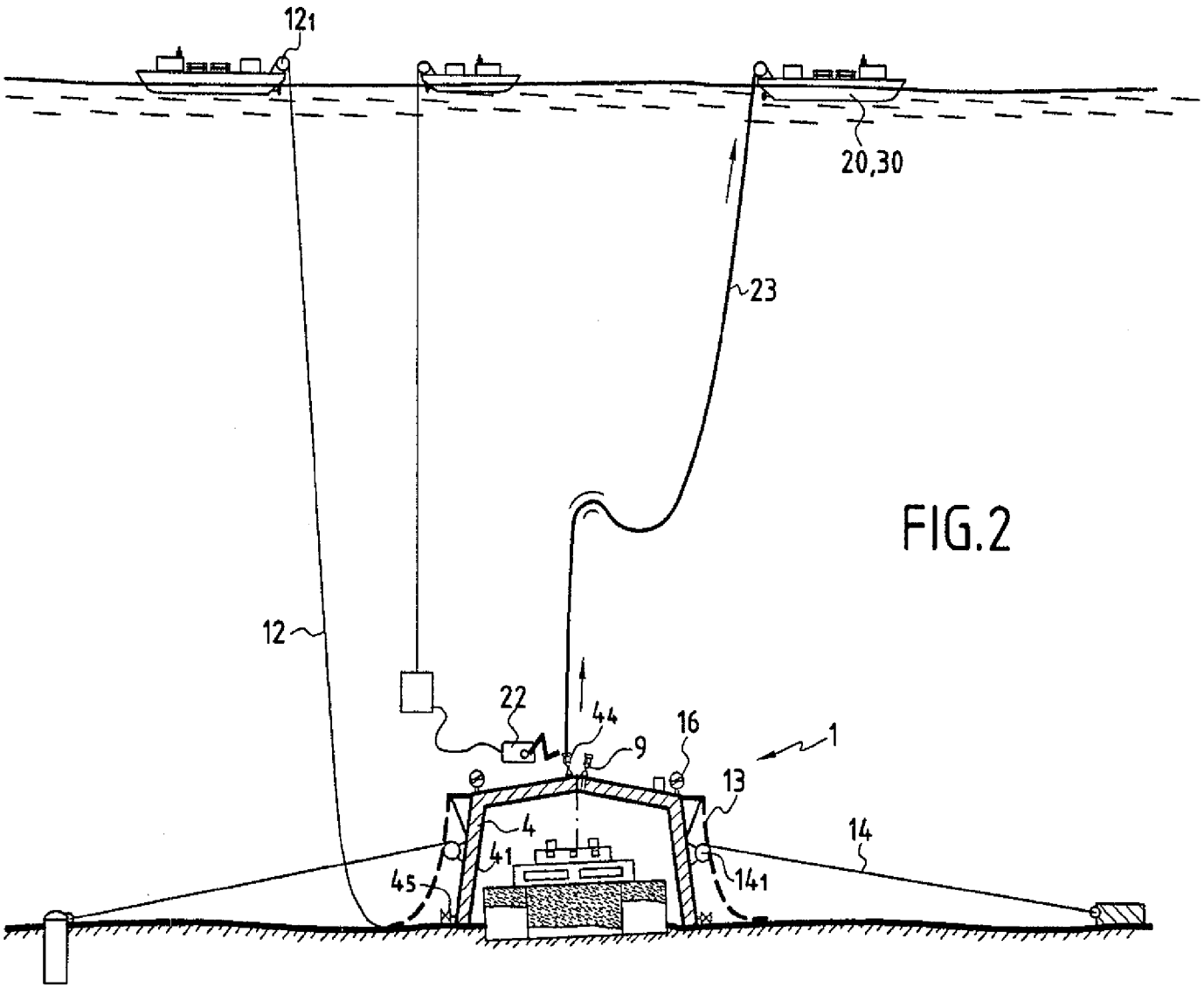
FIG. 2 is a side view in section of a rigid receptacle resting on the sea bed and completely covering the wreck.

A rigid receptacle 1 referred to herein as a "sarcophagus" constituted by a rigid structure is lowered from the surface under the control of cables 12 connected to dynamically-positioned ships 20 on the surface, as shown in FIGS. 1 and 2.

Figure 3:
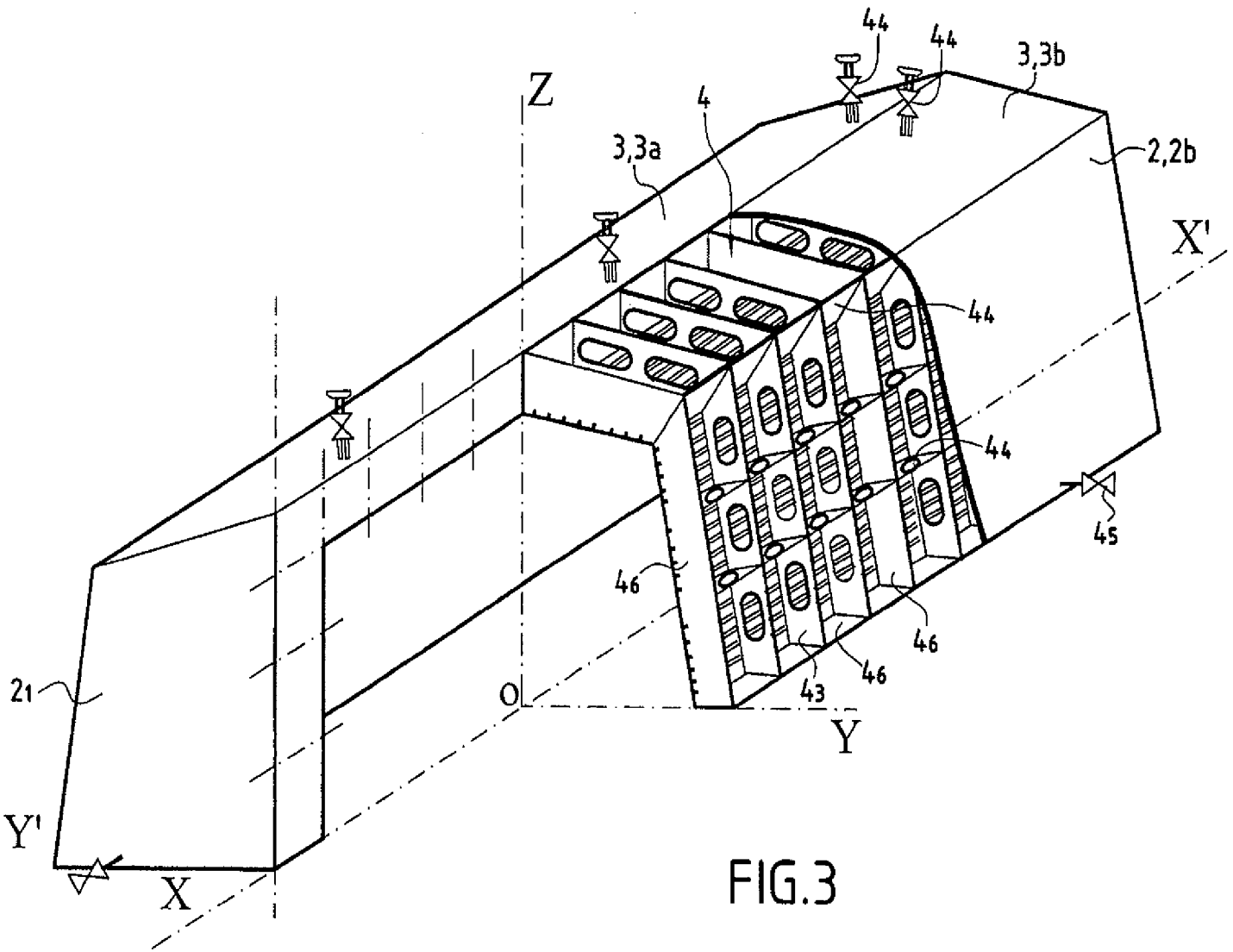
FIG. 3 is a cutaway perspective view showing the structure of the sarcophagus.

The receptacle 1 shown in FIGS. 1 to 3 has a vertical and longitudinal axial plane of symmetry XOZ and comprises:

- a roof wall (3, 3*a*, 3*b*) comprising two longitudinally extending side walls (3*a*, 3*b*) that are inclined relative to said vertical axial plane of symmetry of said receptacle so as to form an upside-down V-shape in cross-section YOZ; and
- a side wall 2 comprising:
  - two longitudinally extending side walls (2*a*, 2*b*) that are vertical or inclined relative to said vertical axial plane of symmetry XOZ, each being contiguous with one of said longitudinally extending roof walls (3*a*, 3*b*); and
  - two transverse end walls ($\mathbf{2}_1$) that are vertical or inclined, preferably symmetrically about a vertical transverse plane of symmetry YOZ.

As shown in detail in FIG. 3, the sarcophagus 1 is constituted by an upside-down hull shape, said hull being leaktight and double-walled, thus constituting walls $\mathbf{4}_1$ of leaktight compartments 4, preferably a multitude of leaktight compartments in continuity one with another. The structure is constituted by transverse framing members $\mathbf{4}_3$ that may be perforated or solid within a given leaktight compartment, and associated with perforated or solid framing members extending longitudinally $\mathbf{4}_6$. In FIG. 3, there can be seen in an exploded cross-section corresponding to the plane YOZ, a right-hand half of the double wall 3*b* of the roof which is plane and inclined relative to the horizontal, e.g. at 10° to 20°, but which could be horizontal, and when it is inclined, it co-operates with the other double-walled half of the roof 3*b* to form a roof with an upside-down V-shape. Each longitudinal roof wall 3*a*, 3*b* is connected via its bottom edge to a plane double-walled side wall 2*a*, 2*b* which is vertical or inclined relative to the vertical, in particular at an angle of 5° to 20°, and preferably at an angle that is smaller than the angle of said inclined longitudinally extending roof walls. The two ends of the sarcophagus 1 in the longitudinal direction XX' are closed by end double walls 2, 2*a*, $\mathbf{2}_1$ that provide a connection between the end edges of the side double walls 2*a*, 2*b* and the ceiling double walls 3, 3*a*, 3*b*, with said end side walls $\mathbf{2}_1$ being perpendicular to the longitudinal axis XX'. The bottom is entirely free so as to enable the sarcophagus to act like a bell to cover the wreck 6 that is to be confined.

The volumes inside the various double walls $\mathbf{2}_1$, 2, 2*a*, 2*b* and 3, 3*a*, 3*b* are defined by the inner and outer walls and by the solid framing members $\mathbf{4}_3$, $\mathbf{4}_6$ that form the walls $\mathbf{4}_1$ of the compartments 4 which are leaktight relative to the outside, thus enabling them to be filled with a fluid of density lower than that of sea water, said fluid then acting as buoyancy material and compensating the dead weight of the rigid structure constituting the sarcophagus receptacle $\mathbf{4}_1$.

Said hull constituting the sarcophagus is advantageously built dry in an open basin, and then the leaktight compartments 4 within the double walls $\mathbf{2}_1$, 2, 2*a*, 2*b* and 3, 3*a*, 3*b* are closed off in leaktight manner. After the open basin has been flooded, the sarcophagus 1 floats, projecting well above water level because said compartments 4 are filled with air. If there is any risk of instability at this stage, it is advantageous to add ballast temporarily to the bottom thereof.

The sarcophagus 1 is then towed to deep water where all of the compartments 4 constituting the buoyancy volumes are filled with the buoyancy fluid, for example gas oil of relative density close to 0.85, but preferably a fluid constituted by ammonia, butane, or propane, or another liquefied gas under pressure, as described below. The buoyancy volume is advantageously adjusted so that the sarcophagus is in neutral equilibrium in water, with overall equilibrium optionally being provided by means of additional floats 19 capable of withstanding deep sea pressures, i.e. about 350 bars for a depth of 3500 m. Said additional floats 19 may be constituted by syntactic foam, i.e. microspheres of glass held captive in a binder of the polyurethane or epoxy resin type, but they are advantageously constituted by a liquefied gas under pressure as described above, and in particular ammonia, butane, or propane.

The sarcophagus 1 is then towed to the site, and once in position, at least two and preferably four ships 20 are connected to the ends of the sarcophagus 1 as follows.

Figure 6:
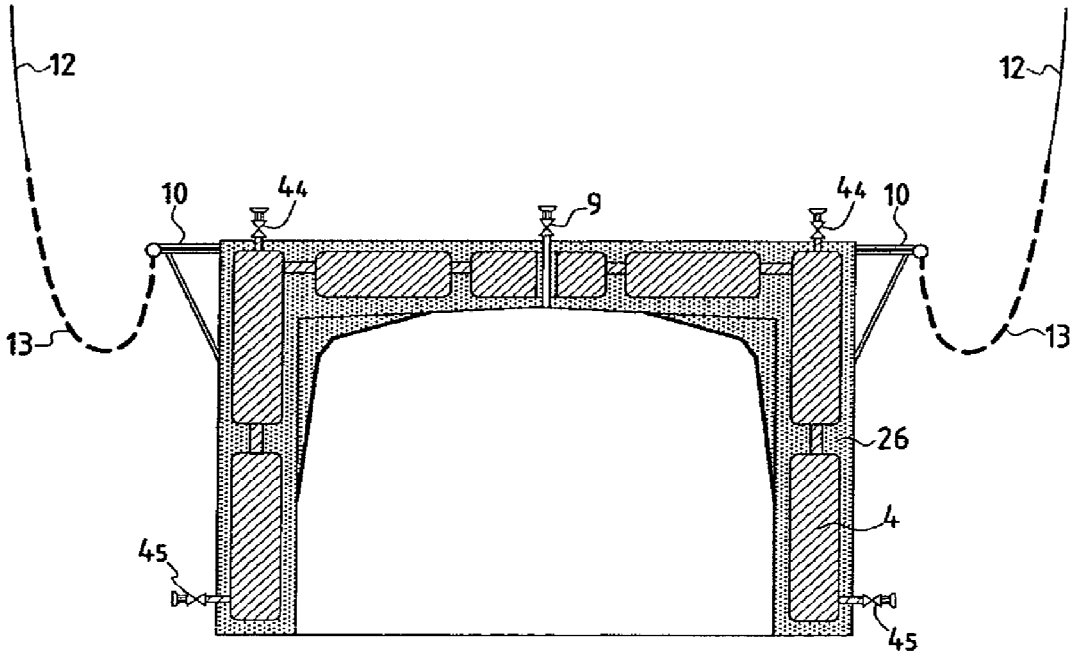
FIG. 6 is a side view in section of a sarcophagus made out of lightweight concrete, having internal volumes forming leaktight compartments filled with a low-density fluid for providing buoyancy.
Figure 6:
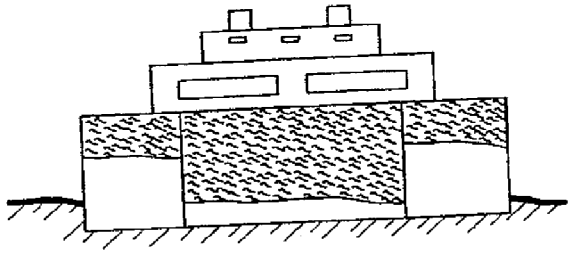

Each ship 20 has a winch $\mathbf{12}_1$ provided with a cable 12, preferably a steel cable, of length that is greater than the depth of the water, e.g. 130% of said water depth. The end of said cable 12 is connected to a length of heavy chain 13, e.g. 100 m of chain having a diameter of 6 inches ("), the end of said chain being connected to a reinforced beam 10 constituting a fastener element secured to the structure and projecting out from the sarcophagus 1, as can be seen in FIGS. 1, 4, and 6.

The heavy chains 13 have a self-regulating effect as the sarcophagus is being lowered towards the sea bed 7, and their operation is explained with reference to FIGS. 4, 4*a*, and 4*b*.

Figures 4, 4A, 4B:
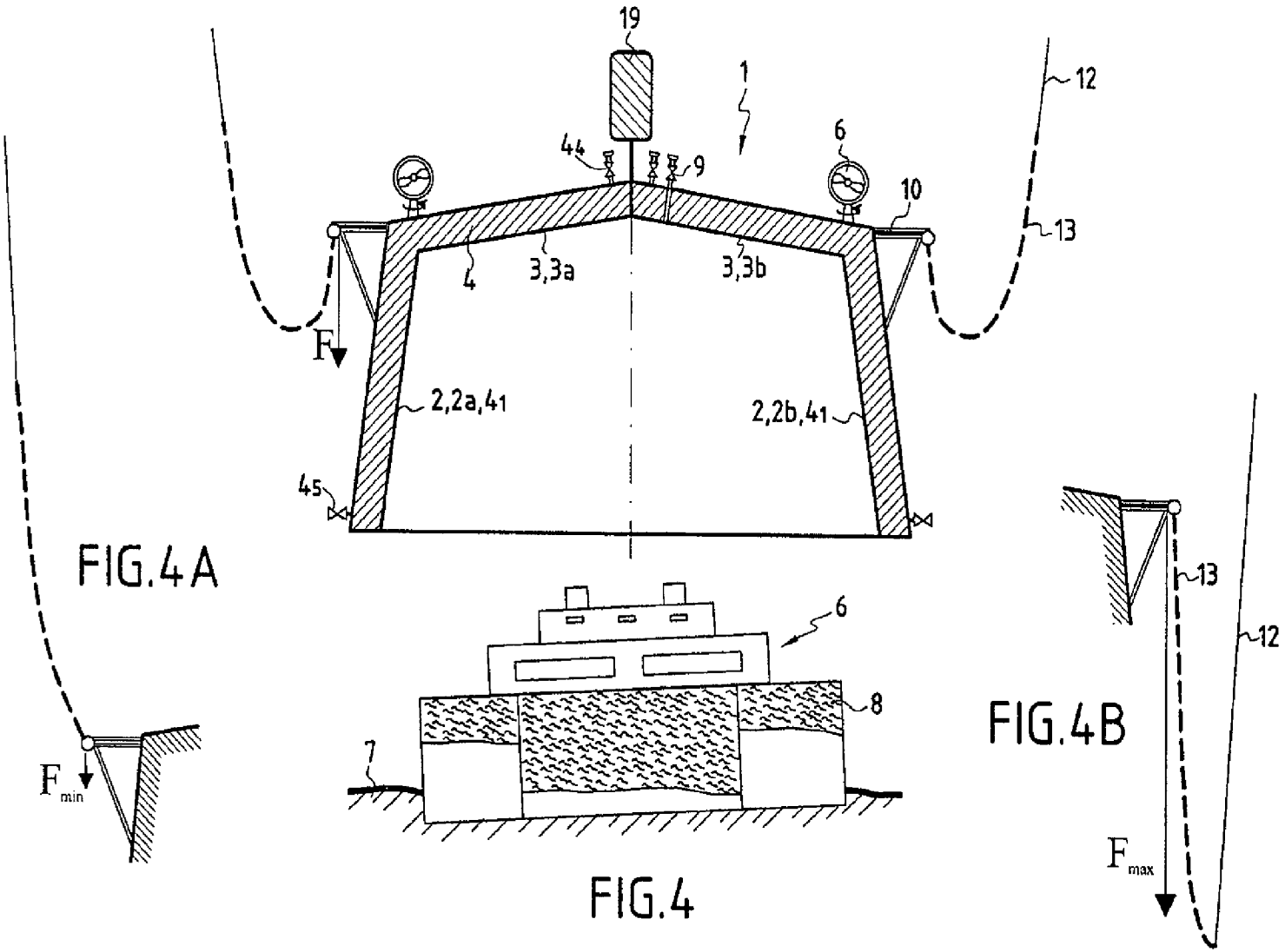
FIG. 4 is a side view in section of the sarcophagus as it is being lowered, showing how lowering is controlled with the help of heavy chains.
FIGS. 4*a* and 4*b* show details of how said heavy chains can be implemented in varying manner.

In FIG. 4, the cable 12 is in an intermediate position and forms a catenary type curve, with a portion of the weight of the chain 13 (F) being supported by the sarcophagus while the remainder of the weight of the catenary is supported via the cable 12 directly by the ship 20 on the surface. Thus, the sarcophagus is maintained in neutral equilibrium under the effect of this force F.

When the winch $\mathbf{12}_1$ on the surface ship 20 winds in the cable 12, it raises the chain 13 as shown in FIG. 4*a*, thereby reducing the weight of chain that is carried by the receptacle to a weight $F_{min}$, since the entire weight of the chain is then supported by the surface ship 20: the sarcophagus 1 then presents an apparent weight in water that is smaller and it rises in order to come closer to an equilibrium position as shown in FIG. 4 and stabilized in that position.

Conversely, when the winch $\mathbf{12}_1$ on the surface ship 20 unwinds cable 12, it lowers the chain 13 as shown in FIG. 4*b*, thus having the effect of increasing the weight carried by the receptacle up to a weight $F_{max}$. The apparent weight of the sarcophagus 1 in water is then increased and it sinks in order to approach the equilibrium position shown in FIG. 4 and be stabilized therein.

Thus, under all circumstances, the configuration of the chains 13 as catenaries produces a self-regulating effect on the position of the sarcophagus while it is being lowered. Nevertheless, it is still appropriate to synchronize the unwinding of the cables 12 from all of the winches $\mathbf{12}_1$ involved in the maneuver in a manner that is very accurate so as to ensure that the sarcophagus 1 is lowered while remaining substantially horizontal. In addition, the ship 20 must remain at a substantially constant distance from the axis of the receptacle, and preferably the two ships 20*a* and 20*b* connected to opposite fastener elements 10 (FIG. 1) should be situated in substantially the same vertical plane as includes the points where the chains 13 are attached to the beams 10 of the sarcophagus 1, which means that it is advantageous for the ships to make use of dynamic positioning techniques relying on a radiolocating system of the GPS type (global positioning system).

The sarcophagus 1 is preferably lowered continuously down to a distance where it is close to the wreck 6, for example 50 m from the sea bed. The sarcophagus is then positioned relative to the axis of the wreck 6 and is oriented in the proper direction by moving the ships 20 on the surface. Said movements of the ships 20 produce an effect that is delayed by several minutes to several tens of minutes on corresponding movements of the sarcophagus situated several thousand meters below. In order to facilitate this operation, it is advantageous to install steerable thrusters 16, preferably at the ends of the structure, and more particularly at the four corners of the roof, said thrusters 16 being powered by an umbilical cord $\mathbf{16}_1$ delivering power and control signals and connected to a surface ship 20.

In the variant shown in FIGS. 1 and 2, winches $\mathbf{14}_1$ are installed on the side peripheral walls of the sarcophagus, and once said sarcophagus 1 is close to the wreck, an automatic underwater remotely operated vehicle (ROV) 22 controlled from the surface connects the cables 14 of said winches $\mathbf{14}_1$ to anchor points $\mathbf{15}_1$, $\mathbf{15}_2$ that have been previously installed in the vicinity of the wreck, e.g. constituted by suction anchors $\mathbf{15}_1$ or by deadweight blocks $\mathbf{15}_2$.

Once the sarcophagus has been put finally into place, the heavy chains rest on the sea bed 7 as shown in FIG. 2, and the additional floats 19 are detached by means of the ROV 22, with these floats then rising freely to the surface where they are recovered. Care can be taken to ensure that each of them is fitted with an acoustic beacon, thus enabling their upward travel to be followed by means of sonars on board the ship 20, and consequently making it possible to move the ships so as to avoid any collision when the floats surface. The sarcophagus 1 is then stable on the sea bed, but its stability can be further improved by recovering its buoyancy material, e.g. gas oil, as shown in FIG. 2. For this purpose, a ROV 22 is used under control from the surface to connect a preferably flexible pipe 23, preferably having an S-shaped configuration, to an orifice that is provided with an isolating valve $\mathbf{4}_4$ and situated in the top of the compartment 4, with care being taken to begin by opening a valve $\mathbf{4}_5$ situated at the bottom of the same compartment 4 so as to allow sea water to penetrate therein as the buoyancy fluid rises to the surface.

After the buoyancy compartments 4 have been emptied of their buoyancy fluid, the top valves $\mathbf{4}_4$ at least are closed and the sarcophagus then presents its maximum weight which provides it with a high degree of stability, even in the event of large amounts of leakage from the wreck. The effluent escaping from the wreck via said leakage collects in the top portion of the internal volume of the sarcophagus, thereby creating significant buoyancy, however this buoyancy is much less than that of the fluid that was in the compartment 4. With highly viscous crude oils, relative density is generally greater than 0.95 and is often close to 1.02, thereby creating little buoyancy and running no risk of destabilizing the sarcophagus.

After the buoyancy compartments 4 have been emptied, the chains may be recovered, however if it is preferred to improve the stability of the sarcophagus, it is advantageous to raise the chains 13 so that their opposite ends are also carried by the beam already carrying their first ends, or else they are raised and merely placed on top of the sarcophagus, so that their entire weight contributes to stabilizing said sarcophagus.

In order to reduce the distance between the double walls defining the compartments 4, and by using light metals, e.g. aluminum for the structure, it is possible advantageously to replace fresh water with a buoyancy fluid of the invention, and in particular preferably ammonia, butane, or propane, as explained below.

The relative density of sea water is about 1.026 at the surface and about 1.045 at a depth of 4000 m and at 3° C., whereas the relative density of fresh water is 1 at the surface and 1.016 at a depth of about 4000 m and a temperature of 3° C., so the buoyancy provided by fresh water per cubic meter ($m^3$) thus lies in the range 26 kilograms (kg) at the surface and 29 kg at a depth of 4000 m. The total volume of the compartments 4 in the following example enable the apparent weight of the sarcophagus structure described below to be balanced. A sarcophagus having aluminum walls, a length of 180 m, a width of 40 m, and a height of 35 m, with a distance of 3 m between its inner and outer double walls represents a mass of aluminum equal to 3000 (metric) tonnes (T), i.e. an apparent weight in sea water of 1850 tonnes. The total volume of the compartments is 73,125 $m^3$, giving a buoyancy of 1480 tonnes when filled to 75% with fresh water. Additional buoyancy of 470 tonnes is applied in the form of floats distributed along the structure, and the stabilizing chains for lowering purposes are constituted by four identical lengths of chain each weighing 50 tonnes, each of them being installed at a corner of the sarcophagus.

For a sarcophagus having the same dimensions and made of steel, it is possible advantageously to use a buoyancy fluid of lower density than fresh water, e.g. gas oil, but preferably a compressed liquid gas of the invention as described below, and the total volume of the buoyancy compartments requires the distance between the inner and outer walls to be 2.5 m. The sarcophagus then presents a mass of 7500 tonnes, i.e. an apparent weight in sea water of 6500 tonnes. The total volume of the compartments is 47,550 $m^3$, giving a buoyancy of 6280 tonnes when filled to 22% with butane of density 601 $kg/m^3$. The additional floats represent 320 tonnes and the stabilizing chains (50T×4) remain the same as for the aluminum sarcophagus.

At the end of installation, a top drainage orifice 9 through the roof of the sarcophagus is advantageously opened so that the buoyancy fluid of the invention can escape and the stability of the sarcophagus can be improved. After the fresh water has been exhausted, said top orifice 9 is closed so as to recover any leakage coming from the wreck.

The same top orifice 9 is advantageously used for recovering the effluent 9 that escapes from the wreck 6 over time, which effluent collects in the top of the inside volume of the sarcophagus underneath its roof 3, 3*a*, 3*b*. By making a connection with this top orifice 9 and after opening the isolating valve, the oil 8 that has accumulated since the preceding campaign is advantageously transferred either by means of a pipe 23 connecting the top orifice 9 to a recovery ship situated on the surface, or else by using a recovery device between the sarcophagus and the surface ship, e.g. a device of the kind described in French patent application No. FR 2 804 935, or indeed a shuttle type device as described in yet-to-be-published European patent application No. 03/358003.6.

Figure 5:
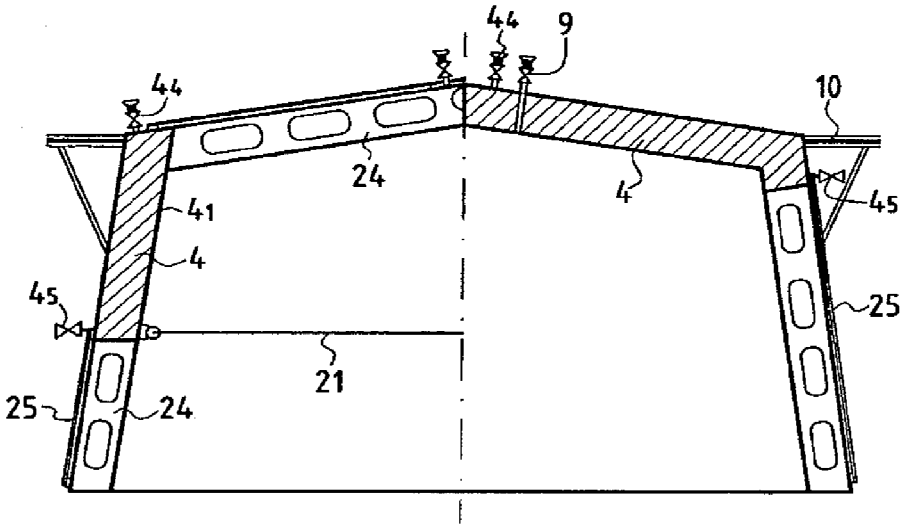
FIG. 5 is a side view in section of a sarcophagus made up of a rigid load-carrying structure made of metal beams associated with buoyancy tanks filled with a low-density fluid integrated between the beams and closed by leakproof diaphragm webs on the outside face of the structure.

In a version of the invention shown in FIG. 5, a hangar type load-carrying structure is made built up from beams of steel or other metal 24 assembled together by welding or bolting, and leaktight compartments are incorporated therein, being distributed continuously or otherwise, either on the side walls 2, 2*a*, 2*b* or in the roof 3, 3*a*, 3*b*, or in both of them. The structure as a whole is made leaktight against a fluid that tends naturally to escape upwards by means of diaphragms or webs 25 fixed outside the structure and against it in leaktight manner, so as to recover all leakage from the wreck and direct it towards a high point where it can be stored while waiting to be recovered, either by means of a bottom-to-surface connection 23 or by means of a recovery device or shuttle as mentioned above.

In a version of the invention shown in FIG. 6, the sarcophagus structure is made of lightweight concrete 26 that is reinforced and prestressed, and it contains compartments 4 which are filled in the same manner as before with a fluid of the invention of density lower than that of sea water. The concrete 26 is advantageously made using lightweight aggregate, such as expanded clays for example, associated with high-strength mortars, thus giving excellent behavior at great depth, even at depths of 3000 m to 4000 m, or even more. Expanded clays are substantially spherical in shape leaving gaps that are filled with air or gas, thus giving them very low density; when taken within a matrix constituted by high strength mortar, it is the matrix proper which provides overall strength. When the structure is subjected to very high pressures, e.g. the pressure of 400 bars that exists at a depth of about 4000 m, water will migrate over time into the mass of concrete and will, little by little, invade the expanded clay aggregate, thereby considerably increasing the apparent weight of the sarcophagus. Since this migration process is relatively slow it is not a disadvantage during installation since after being towed to the site, the critical operation of lowering said sarcophagus from the surface to its final position resting on the sea bed over the wreck will occupy a maximum duration of 12 hours (h) to 24 h. Once in place, the dead weight of the sarcophagus increases day by day, thereby increasing its stability, with the water migration phenomenon continuing over a period of several weeks or even several months. In order to retard water migration phenomena into the porous aggregate, it is advantageous to cover the walls of the concrete structure that come into contact with water completely in a layer of elastomer type paint, thereby creating an effective sealing barrier. This layer is advantageously also applied to the inside of the buoyancy compartments integrated in the concrete structure in order to minimize migration of buoyancy fluid into said aggregate.

In a preferred version of the invention, it is advantageous to use a buoyancy fluid of the invention of very low density, thus reducing the overall volume of the buoyancy compartments that are to be provided. For this purpose, it is advantageous to use a gas having a critical point that is above ambient temperature, e.g. butane, propane, ammonia, or any other similar compound that is gaseous at ambient atmospheric temperature and pressure. In the liquid state these gases have relative density that lies in the range 0.50 to 0.70. These compounds are gaseous at atmospheric pressure and at a temperature of 20° C., but they liquefy once they have been compressed to a few bars. It is thus highly advantageous to use them as buoyancy fluid since their efficiency ω (buoyancy thrust/dead weight) is much greater than that of the fluids that are currently used, such as gas oil, methanol, or even fresh water.

For a gas oil of density 0.85: $\omega=1.21$, for methanol: $\omega=1.30$, whereas for butane, propane, and ammonia, the values of ω are $\omega=1.71$, $\omega=1.97$ and $\omega=1.63$, respectively.

However, the compartments then need to be filled in a particular manner in order to avoid any risk of accidents or difficulties. Since these compounds are gaseous at ambient temperature and at atmospheric pressure, they can be stored either at atmospheric pressure and at cryogenic temperature, or under pressure and at ambient temperature.

When they are stored at atmospheric pressure, to ensure that the fluid remains in liquid form, the temperature of said fluid must be kept well below ambient temperature, e.g. in the range 0° C. to −50° C. depending on the gas.

When they are stored at ambient temperature, generally about 20° C. to 30° C., or even greater, in order to keep them in the liquid state, they must be confined in tanks that are capable of withstanding high pressures of several bars to several tens of bars depending on the gas.

Storage at low temperature is very difficult, indeed almost impossible, to achieve when the buoyancy volume is large, since it is essential that the gas does not become heated. On heating, the fluid begins to boil, and the pressure inside the tank increases. If the tank is leaktight, then it must be capable of withstanding the maximum pressure of the gas; if the tank is not leaktight and communicates with the outside, then the boiling gas thus escapes, thereby reducing the quantity of liquid gas present, and consequently reducing the buoyancy.

Storage at ambient temperature requires confinement means for confining said gas under pressure so that it remains in the liquid state. Commercially-available bottles and tanks of butane or propane gas are capable of withstanding very high pressures, but they remain heavy, and it would not be advantageous to use them as such, since the buoyancy efficiency c would be significantly degraded by the weight of said confinement means constituted by the dead weight of said tank capable of withstanding the pressure. It is possible to envisage using tanks made of composite materials presenting density that is close to that of water, but they are costly and complex to manufacture once their unit volume becomes large.

Thus, in order to contain the buoyancy fluid in the liquid state, a rigid or flexible casing is advantageously used that is capable of confining said gas, with said casing being filled underwater at a depth of water such that the hydrostatic pressure at said depth of water corresponds to the buoyancy material at a temperature that is not greater than ambient temperature being a liquid state that is stable. In general, the temperature of sea water lies in the range 3° C. to 25° C., or even greater, depending on geographical region, the period of the year, and the depth under consideration, and may descend to −5° C., or even −7° C., in particular arctic regions.

To this end, for a heavy structure such as a sarcophagus or the like, the procedure is as follows:

after constructing the heavy structure or the sarcophagus 1 on land or in dry dock, it is launched; and then said heavy structure or said sarcophagus 1 is supported close to the surface by means of cables connected to winches installed on barges 27, preferably two or four barges, floating on the surface as shown in FIGS. 7*a*, 10*a*, and 10*b*, the sarcophagus being connected to each of said barges 27 by a cable 28 connected to a winch $\mathbf{28}_1$, in association with a pounding compensator 29 seeking to ensure that the cable 28 does not break. The compartments 4 or rigid casings $\mathbf{19}_1$ (to the left in FIGS. 10*a*-10*b*) are filled with water, and the flexible casing $\mathbf{19}_1$ of the bag type being empty of air and of water is collapsed onto itself as shown in FIG. 10*a* (to the right); and the structure or the sarcophagus 1 is transported at sea to the installation site, and then, as explained with reference to FIGS. 7*b* and 10*b*, it is lowered to a depth of 20 m to 60 m corresponding substantially to a pressure of 2 bars to 6 bars, at which pressure the butane gas that is to be injected into the compartments 4 and the tanks $\mathbf{19}_1$ is liquid. A pipe 23 is then lowered and connected to the high point 44 of the buoyancy compartments and to valves $\mathbf{19}_2$, $\mathbf{19}_4$ of the buoyancy elements 19, and liquid gas stored on board a specialized gas tanker ship 61 (known to the person skilled in the art), is injected under pressure. The bottom orifice $\mathbf{4}_5$ of the compartment 4 is left open so the liquid gas expels the sea water therein and fills the compartment 4 completely, little by little. At the end of filling, the top valve $\mathbf{4}_4$ is closed in leaktight manner. The flexible bag $\mathbf{19}_1$ is filled via its sole orifice $\mathbf{19}_4$ with filling being controlled in such a manner as to avoid bursting it. Once full, the valve $\mathbf{19}_4$ is closed and disconnected from the filling pipe 23. Once all of the compartments and casings have been filled, the barges 27 used during towing can be released after the retaining cables 28 have been disconnected; and said heavy structure or said sarcophagus is then ready to be lowered as explained above, after connecting the heavy chains 12, 13 which then act as stabilizers throughout the descent to the sea bed.

In FIG. 7*b*, the right-hand compartment 4 is full of buoyancy fluid in the liquid state, whereas the left-hand compartment is being filled, with sea water escaping through the bottom valve $\mathbf{4}_5$ which is in the open position. In FIG. 10*b*, the compartments 4 constituted by the tubular bars of the load-carrying structure, and the rigid buoyancy element 4-19, $\mathbf{19}_1$ to the left, are full of buoyancy fluid in the liquid state, while the buoyancy element to the right having a flexible casing of the bag type is being filled with said fluid.

At the end of installation, it can suffice to open the top orifice $\mathbf{4}_4$ situated at the top of each of the buoyancy compartments 4 to a small extent so as to allow the gas to escape in liquid form: It then rises naturally towards the surface, initially in liquid form and finally in the form of gas close to the surface where it becomes diluted in the atmosphere. These gases are not dangerous for the environment or for personnel, insofar as the instantaneous quantities thereof remain reasonable, i.e. constituting a few tens or a few hundreds of kilograms per hour, but for ecological reasons it is nevertheless preferable to recover the cargo of liquefied gas. For this purpose, a bottom-to-surface connection 23 is installed as described above with reference to FIG. 2, which connection connects the top orifice $\mathbf{4}_4$, $\mathbf{19}_2$ of each compartment and buoyancy element to the gas tanker ship 61 situated at the surface. The connection enables nearly all of the gas cargo to be recovered in a very short length of time since the gas in liquid form presents viscosity that is extremely low. And because of the very great depth of water, the pressure difference between the inside of said pipe and the outside is considerable, since the pressure difference increases by about 4 MPa for each additional 1000 m of depth for a buoyancy fluid of the butane type, since its density is about 0.6 times that of sea water.

For heavy structures, e.g. well-head elements or oil processing or pumping units, that are to be lowered to the sea bed, the equipment-carrying structure is made with tubular bars, rather than with I-, U-, or H-section bars, as is currently the practice. Said tubular bars are made leaktight, then they are filled with liquefied gas in the same way as described above with reference to FIG. 7*b*, through orifices provided with valves provided for this purpose.

The tanks or reservoirs $\mathbf{19}_6$ of the oil processing unit are also advantageously used as rigid casings that are capable of receiving liquefied gas and that are purged after installation and before the oil processing unit installed on the sea bed is put into operation.

The additional buoyancy elements 19 are advantageously made from a flexible casing constituting a bag functioning as a dirigible balloon, as shown in FIG. 10*b*. The casing is flexible and leaktight, preferably in the shape of an upside-down water droplet, or even spherical shaped when it is full. It is connected to said heavy structure by a bundle of cables 59, preferably surrounding said flexible and leaktight casing, said bundle of cables 59 being secured to the heavy structure and being capable of transferring the buoyancy thrust that is exerted on said casing full of said liquefied gas, to said heavy structure 1. Said bag is filled in the same way as described in FIG. 7*b* and it is emptied at the end of installation merely by opening the valve 19.4 connected to a pipe 23.

The flexible casing of the bag is advantageously made with rubber-coated resistant fabric of the neoprene type, or with polyurethane compounds, such as those which are used for inflatable boats sold under the trademark ZODIAC®, or else for manufacturing flexible tanks sold by PRONAL® France.

The preferred gases that can be used as buoyancy fluid are listed in Table 1 below in order of increasing density, in the liquid state, at a temperature of 15° C.

The vapor pressures indicated in Tables 1 and 2 are absolute pressures, i.e. relative to a vacuum.

The corresponding depth is indicative and corresponds substantially to an atmospheric pressure of 0.1 MPa and to sea water of density 1.026 relative to fresh water.

TABLE 1

| fluid | density in the liquid state kg/m³ at 15° C. | vapor pressure at 15° C. absolute pressure MPa (×10⁶ Pa) | depth of water (at sea) m |
|---|---|---|---|
| ethylene | 322 | 4.9 | 468 |
| ethane | 401 | 3.38 | 320 |
| acetylene | 465 | 4.09 | 389 |
| propane | 519 | 0.77 | 65 |
| propylene | 547 | 0.9 | 78 |
| butane | 601 | 0.176 | 7.5 |
| propadiene | 609 | 0.62 | 51 |
| butene | 619 | 0.22 | 11.7 |
| trans-butene | 627 | 0.46 | 35 |
| ammonia | 629 | 0.77 | 65 |
| methyl acetylene | 644 | 0.44 | 33 |
| butadiene | 645 | 0.203 | 10 |
| cis-butene | 645 | 0.132 | 3.1 |

The gases are classed in Table 2 below by order of vapor pressure at a temperature of 15° C.

TABLE 2

| fluid | density in the liquid state kg/m³ at 15° C. | vapor pressure at 15° C. absolute pressure MPa (×10⁶ Pa) | depth of water (at sea) m |
|---|---|---|---|
| cis-butene | 645 | 0.132 | 3.1 |
| butane | 601 | 0.176 | 7.5 |
| butadiene | 645 | 0.203 | 10 |
| butene | 619 | 0.22 | 11.7 |
| methyl acetylene | 644 | 0.44 | 33 |
| trans-butene | 627 | 0.46 | 35 |
| propadiene | 609 | 0.62 | 51 |
| propane | 519 | 0.77 | 65 |
| ammonia | 629 | 0.77 | 65 |
| propylene | 547 | 0.9 | 78 |
| ethane | 401 | 3.38 | 320 |
| acetylene | 465 | 4.09 | 389 |
| ethylene | 322 | 4.9 | 468 |

When the fluid storage ship is of the cryogenic type, i.e. the fluid is stored substantially at atmospheric pressure, at a temperature well below 0° C., e.g. −42° C. for propane, in order to transfer said fluid to the bag or the tank, the procedure is slightly different from that explained above. The fluid is extracted from the cryogenic tanks by a pump, and then on passing through a sea-water heat exchanger becomes heated to a temperature close to that of sea water, e.g. 15° C. on leaving the heat exchanger. It then goes down towards the bag or the tank through the pipe 23 and the fluid remains in the liquid state because the pressure in the pipe between the pump to the bag is greater than the vapor pressure of the fluid at 15° C. (0.77 MPa for propane).

Recovering the gas at the end of installing the heavy structure then requires a liquefier unit to be implemented since the fluid coming from very great depths is at a temperature of about 4° C. and needs to be cooled down to a temperature of less than −42° C. (for propane) in order to remain in the liquid state in the tanks of said cryogenic ship, which tanks are substantially at atmospheric pressure.

At low temperature, butane and propane tend to combine with water to form hydrates that run the risk of blocking the pipework or of preventing the liquefied gases from being recovered at the end of the installation stage. When the casing is initially filled with water, in order to avoid these hydrates forming when beginning to fill a said rigid or flexible casing, a volume of methanol, e.g. 100 liters (L) or 200 L, is injected so that the methanol which is of a density that is intermediate between sea water and the liquefied gas creates a screen preventing direct contact between the butane/propane and the water. In addition, when mixed in small amounts with water, methanol prevents the chemical reactions that lead to hydrates being formed.

In each of the variants of the invention described above, the leaktight compartments are positioned and dimensioned in such a manner as to comply with the rules applicable to ship-building, and in particular with the ρ−a rule which consists in ensuring that the center of vertical thrust due to buoyancy remains above the center of gravity of the structure. It is common practice to consider that for a value of ρ−a>1 m, the structure can be considered as being stable and not in risk of turning over by pivoting about its axis XX'. For this purpose, it is advantageous to add external floats 19 which are preferably situated above the structure of the sarcophagus, and possibly also to ballast its bottom portions.

FIGS. 8*a* to 8*d* and 9 show a shuttle tank 32 of the type serving to recover effluent from a wreck on the sea bed by lowering and raising said shuttle tank respectively when empty and when full, between the surface and the bed of the sea. The shuttle tank 32 is constituted by a side wall 34 that is flexible and leaktight, e.g. made of strong reinforced plasticized fabric, said side wall being secured at its top portion to a dome 33 having a circular horizontal section and having a bullet-shaped profile in vertical section, and that is made of a strong and rigid material, preferably a composite material, and said side wall being secured at its bottom portion to a plane, solid, strong, rigid, and preferably circular bottom wall 35, which is itself also preferably made of composite material so as to represent a minimum apparent weight in water, while guaranteeing extreme rigidity and strength. Said bottom wall 35 is pierced at its center by a main orifice $\mathbf{35}_1$ and is fitted with a valve, preferably a draw-off valve, e.g. of the guillotine type, said valve being fitted with a flange. A complementary side orifice of smaller diameter is provided with a valve $\mathbf{35}_2$, thereby enabling sea water to be exchanged between the inside of the shuttle tank and the marine environment, and in particular enabling sea water to escape while the tank is being filled with oil.

The dome 33 and the bottom wall 35 can present a diameter in the range 5 m to 10 m, the dome 33 can present a height in the range 2 m to 5 m, and the side wall 34 can present a height in the range 10 m to 50 m, once deployed.

The apparent weight in water of the shuttle tank 32 is advantageously adjusted by integrating buoyancy into the highest portion of the dome 33, e.g. syntactic foam $\mathbf{33}_1$ constituted by microspheres of glass coated in epoxy, polyurethane, or other resins.

The shuttle tank 32 is thus lowered to the wreck or tank 6, or even to a sarcophagus 1 placed over a said wreck or tank, in the collapsed position, and presents an apparent weight in water that is very light and that can be adjusted both positively and negatively, thereby making it easy to install directly by using an ROV controlled from the surface and provided with manipulator arms.

FIG. 8 shows that the raising of the shuttle tank 32 is controlled by a connection cable 12 having a fraction of its bottom portion 13 that is weighted, e.g. by metal blocks 31 secured to said cable 30 by clamping at $\mathbf{3}_{11}$ like a string of beads.

Figure 8A:
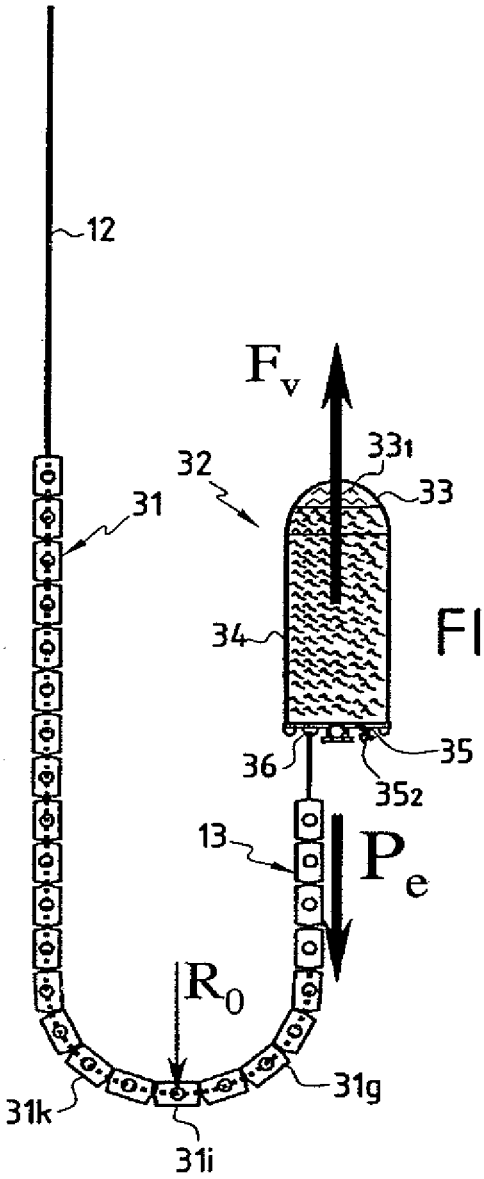
FIG. 8*a* is a side view of a shuttle tank that is stabilized, while rising, by a connection cable that is weighted by blocks secured to said cable and also serving to limit curvature.
Figure 8B:
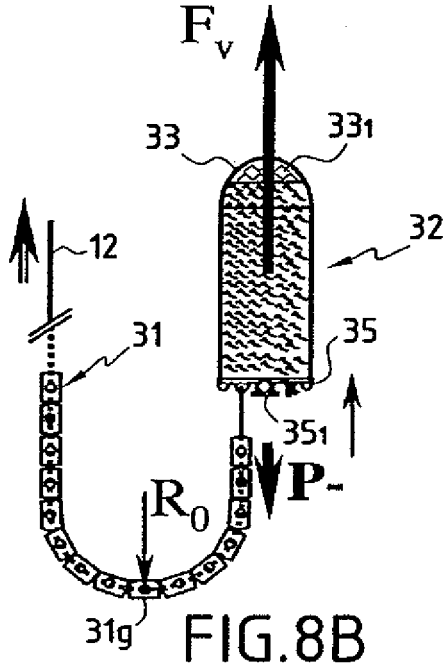
FIGS. 8*b* and 8*c* show states similar to those in FIG. 11*a*, with the shuttle tank being in the rising stage in FIG. 11*b* and in the lowering stage in FIG. 8*c;*
Figure 8D:
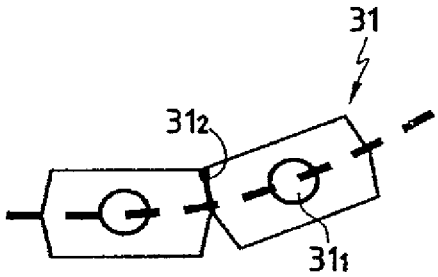
FIG. 8*d* shows a detail of two blocks 31 in contact with each other, when said connection cable is curved.

As shown in FIG. 8*d*, the beads 31 have a cylindrical central body that is prismatic or circularly cylindrical, and frustoconical ends, so that when the cable is curved, the frustoconical ends of two adjacent beads thus come into abutment against each other at $\mathbf{31}_2$, thereby limiting the local radius of curvature to a value that is greater than $R_0$. Thus, the connection cable 12, being fastened to the shuttle tank 32 at said first fastener point 36 at the bottom of the tank, descends, then moves away through an arc of a circle of radius $R_0$, before finally rising vertically or in a catenary configuration at a distance of about at least $2R_0$ from the side wall 4 of said shuttle tank, thereby avoiding any mechanical contact during raising, and thereby preventing said connection cable from being damaged by rubbing.

In FIG. 8*a*, the buoyancy of the shuttle tank filled with hydrocarbons $F_v$ that corresponds to the buoyancy thrust that is exerted on the tank and its cargo is compensated by the weight of the cable up to the horizontal tangent point corresponding to the bead $\mathbf{31}_i$, added to the weight of the beads $\mathbf{31}_g$ between the tank and the lowest bead $\mathbf{31}_i$, i.e. 8.5 beads in FIG. 11*a*, the overall weight $P_e$ thus corresponding to the system being in equilibrium.

By way of example, in order to illustrate FIG. 8*a*, the shuttle tank having a volume of 250 $m^3$ of oil of density 1011 $kg/m^3$, in sea water at 3° C. of density 1045 $kg/m^3$, has a buoyancy of about 8.5 tonnes.

Each of the beads of the equilibrium device 30-31 thus has a weight in water of about 1 tonne.

In FIG. 8*b*, the top end of the connection cable 12 connected to a winch installed on board a surface ship (not shown) is raised, thereby bringing the bead $\mathbf{31}_g$ into the bottom horizontal position, and thereby reducing the number of beads hanging from the tank to 6.5 beads, the overall weight opposing the $F_v$ thrust thus being reduced to P−. The resultant $F_v$+P− is thus upwardly positive and the shuttle tank can rise until the force equilibrium of FIG. 8 is reached.

Figure 8C:
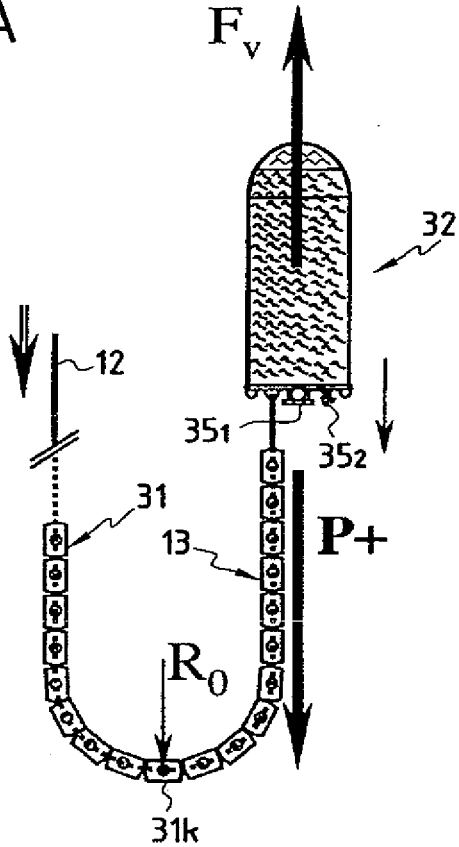

In addition, in FIG. 8*c*, the top end of the connection cable 12 is veered (lowered), thereby bringing the bead $\mathbf{31}_k$ into the bottom horizontal position, and thereby increasing the number of beads hanging from the tank to 10.5 beads, with the overall weight thus being equal to P+. The resultant $F_v$+P− is thus upwardly positive and the shuttle tank can rise until the force equilibrium of FIG. 8*a* is reached.

Thus, the stabilizing device of the invention presents a stabilizing effect while the shuttle tank is being raised. When the surface ship moves excessively under the effect of swell or moves away from the vertical above the position of the shuttle tank, the movements have an instantaneous effect on only the zone of the beads surrounding the beads $\mathbf{31}_g$ to $\mathbf{31}_k$, the bead $\mathbf{31}_i$ corresponding to the mean value of the oscillations.

Thus, in order to control the raising of the shuttle tank 32, it suffices to wind the connection cable onto the winch situated on board the surface ship 20 at a speed that is compatible with the natural rate of rise of said shuttle tank, with said shuttle tank naturally always seeking to return to its equilibrium position shown in FIG. 8*a*. In the event of difficulties, it suffices to slow down or stop winding onto the winch, the shuttle tank then finding its position of equilibrium almost immediately, while waiting for the winch to restart.

Figure 9:
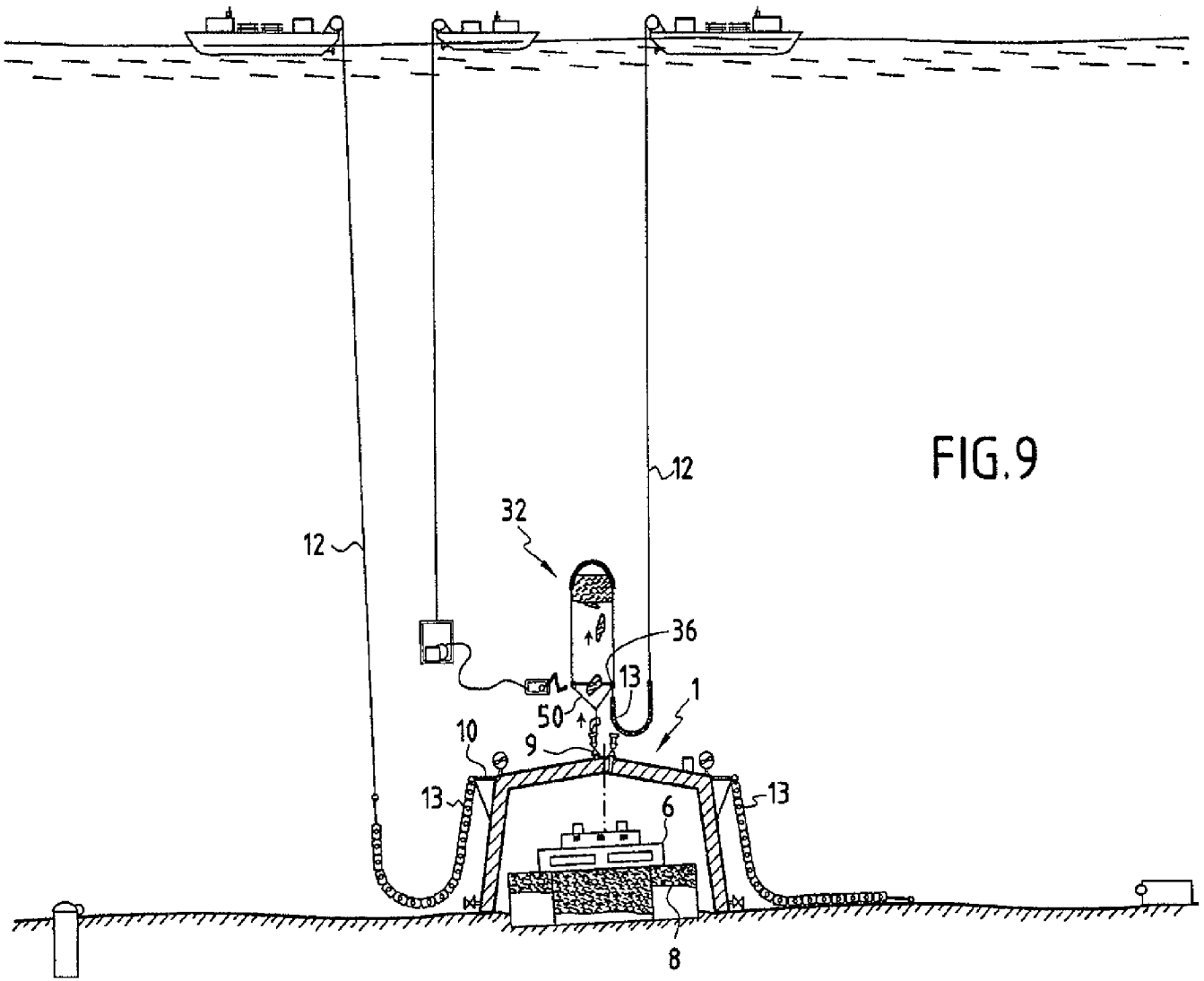
FIG. 9 shows a shuttle tank co-operating with the top wall of a structure of the sarcophagus type, for recovering therefrom, the oil flowing from a ship that has sunk and that is confined beneath the sarcophagus.

FIG. 9 shows a shuttle tank 32 installed in register with of an emptying device 9 fitted with a valve provided on the top wall of a sarcophagus 1 to which said shuttle tank is connected by a connection 50. When the valve is in its open position, it passes through the crude oil that has accumulated inside said sarcophagus, after flowing out from the tanks of the ship 6. It can thus be collected in the shuttle tank, which can be raised to the surface once full and once the connection 50 has been broken, with the rise to the surface being performed under the control of a device of the invention for stabilizing and controlling raising and lowering. The sarcophagus 1 is fitted with a stabilizing and control device having connection elements 12 constituted by cables, each having a bottom portion that comprises a string of metal blocks 31.

The device for controlling the lowering or raising of a heavy or massive structure is described above as being constituted either by a cable provided with blocks or beads clamped onto said cable, or by a chain having links that are modified so as to create the minimum radius of curvature $R_0$ merely by abutment between links. But, it is not beyond the ambit of the invention for said heavy portion of said connection elements to be constituted by a string of heavy bars that are hinged together so that deformation of the string of hinged bars creates a load imbalance of P+ or P− relative to the equilibrium load Pe, as described above with regard to FIGS. 8*a*, 8*b* and 8*c*, said bars advantageously presenting mechanical abutments at the hinges, making it possible to limit the curvature to a minimum value $R_0$.

Figure 11:
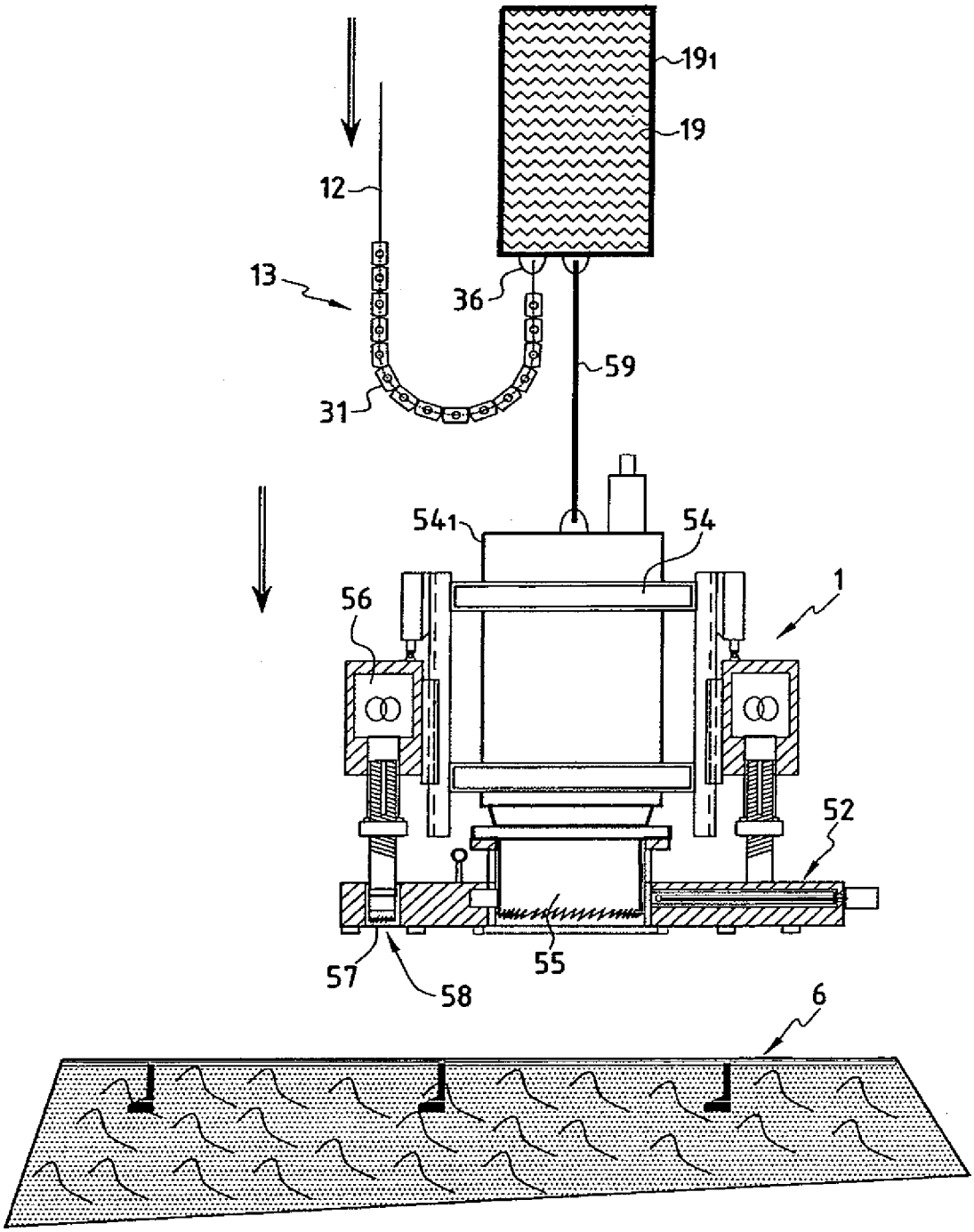
FIG. 11 shows the lowering of a structure consisting of an anchoring and drilling device controlled by a stabilizing chain and by buoyancy elements of the invention.

FIG. 11 shows a heavy structure consisting of a device 1 for placing and anchoring a base 52 on the wall 54 of a tank and/or of a shipwreck on the sea bed. The device 1 comprises a support structure 54 constituted by a rectangular machine-welded stand, itself supporting:

- a drill body $\mathbf{54}_1$ comprising means for actuating a crown saw 55 both in translation and in rotation, which saw, through a corresponding opening provided in said base, enables a large orifice to be pierced in said wall 6 so as to allow fluid contained in said tank to be evacuated; and
- side carriages 56 comprising means for actuating crown saws 57 both in translation and in rotation that are capable of piercing holes in said wall 6 in order to anchor the base 52 to said wall, the crown saws 57 being displaced through orifices 58 in said base.

FIG. 11 shows the lowering of a structure 1 consisting of an anchoring and drilling device controlled by a stabilizing chain 12, 13 of the invention, and by a buoyancy element 19 of the invention. The bottom lefthand portion of the base 52 is shown in section in order to show the cutting means 57 inside an orifice 58 provided in said base.

The device 1 is suspended by a connection 59 from a buoyancy element 19. A connection element 12 of the cable type, having a bottom portion 13 comprising weighting blocks 31 disposed in a string as mentioned above, and extending from a surface-floating support to a fastener element 36 at the base of a buoyancy element 19, makes it possible to control the speed at which the device 1 is lowered and raised, and where appropriate, makes it possible to stabilize it in the vicinity of the wall 6, in accordance with the present invention.

The buoyancy fluid of the invention is described above in order to facilitate installing loads or heavy structures in extreme depths, but it can also be used advantageously to act as a permanent float on underwater structures such as oil or gas production towers or towers for injecting water that are installed on oil fields under great depths of water, in the range 1000 m to 3000 m, or even greater, as described in particular in WO 00/49267 and WO 03/95788 in the name of the Applicant.

The buoyancy fluid of the invention can be used at any depth, but because of its particular implementation it is of greater advantage at great depths. It is particularly advantageous for abyssal depths, e.g. 10000 m or 11000 m, or deeper, since it is quasi-incompressible, i.e. its volume does not vary significantly when the depth of water and thus the pressure increases. For very great depths (4000 m to 5000 m and greater), its volume shrinks by a few percent, but sea water which is likewise quasi-incompressible also has its density increased perceptibly. Since the volume of the buoyancy fluid decreases while the density of the sea water increases, there is a small resulting variation in the buoyancy thrust, and thus in the buoyancy, and this is compensated automatically by the connection(s) 12, 13 as described above, and so the point of equilibrium varies slightly as a function of said variation in buoyancy.

What is claimed is:

1. An underwater buoyancy element, comprising:

a casing;

a buoyancy fluid having a density that is less than that of sea water, and that is confined in said casing, wherein said buoyancy fluid is naturally in a gaseous state at ambient atmospheric temperature and pressure, and naturally in an entirely liquid state at the underwater depth to which said buoyancy element is immersed.

2. The underwater buoyancy element according to claim 1, wherein said buoyancy fluid is naturally in a stable liquid state when it is placed at an underwater depth of 10 m to 500 m.

3. The underwater buoyancy element according to claim 1, wherein said buoyancy fluid is a fluid that is quasi-incompressible, and that has a relative density in a liquid state of 0.3 to 0.8.

4. The underwater buoyancy element according to claim 1, wherein said buoyancy fluid is selected from the group consisting of: ammonia, a C-2 to C-7 alkane, a C-2 to C-7 alkene, a C-2 to C-7 alkyne, and a C-4 to C-7 diene.

5. The underwater buoyancy element according to claim 4, wherein said buoyancy fluid is selected from one of the group consisting of: ammonia, ethane, butane, propane, ethylene, propylene, butene, acetylene, methyl acetylene, propadiene, and butadiene.

6. The underwater buoyancy element according to claim 5, wherein said compound is selected from one of ammonia, propane, and butane.

7. The underwater buoyancy element according to claim 1, wherein said casing comprises one of walls defining an immersed structure, and being disposed in a compartment of an immersed structure.

8. The underwater buoyancy element according to claim 1, wherein said casing is disposed outside of and is coupled to an immersed structure.

9. The underwater buoyancy element according to claim 8, wherein said immersed structure is suspended from said buoyancy element by at least one cable.

10. The underwater buoyancy element according to claim 1, wherein said buoyancy element imparts buoyancy to an immersed structure to which it is one of connected, secured, or in which it is integrated.

11. The underwater buoyancy element according to claim 10, wherein said casing is flexible, and has a hydrodynamic profile for minimizing forces during vertical movements of the underwater buoyancy element when the underwater buoyancy element is full of said buoyancy fluid.

12. The underwater buoyancy element according to claim 1, wherein said casing is disposed in a compartment of an immersed structure.

13. The underwater buoyancy element according to claim 1, wherein the underwater depth to which said buoyancy element is to be immersed is no less than about 1000 meters.

14. An underwater buoyancy element, comprising:

a casing; and a buoyancy fluid having a density that is less than that of sea water, the buoyancy fluid confined in and entirely filling said casing, wherein said buoyancy fluid is naturally in an entirely liquid state when maintained at a pressure and temperature identical to the pressure and temperature of sea water at the underwater depth to which said buoyancy element is to be immersed, and is naturally in a gaseous state at ambient atmospheric temperature and pressure at sea level.

15. The underwater buoyancy element according to claim 14, wherein the underwater depth to which said buoyancy element is to be immersed is no less than about 1000 meters.

* * * * *